US009716355B1

(12) United States Patent
Cole

(10) Patent No.: US 9,716,355 B1
(45) Date of Patent: Jul. 25, 2017

(54) PLUG AND RECEPTACLE HAVING HIGH DENSITY OF ELECTRICAL CONTACTS AND/OR PINS

(71) Applicant: CISCO TECHNOLOGY, INC., San Jose, CA (US)

(72) Inventor: George Glen Daniel Cole, Allen, TX (US)

(73) Assignee: CISCO TECHNOLOGY, INC., San Jose, CA (US)

( * ) Notice: Subject to any disclaimer, the term of this patent is extended or adjusted under 35 U.S.C. 154(b) by 0 days.

(21) Appl. No.: 15/053,919

(22) Filed: Feb. 25, 2016

(51) Int. Cl.

| | |
|---|---|
| ***H01R 25/00*** | (2006.01) |
| ***H01R 24/64*** | (2011.01) |
| *H01R 107/00* | (2006.01) |
| *H01R 27/02* | (2006.01) |
| *H01R 24/62* | (2011.01) |
| *H01R 31/06* | (2006.01) |

(52) U.S. Cl.
CPC ..... *H01R 24/64* (2013.01); *H01R 24/62* (2013.01); *H01R 27/02* (2013.01); *H01R 31/06* (2013.01); *H01R 2107/00* (2013.01)

(58) Field of Classification Search
USPC ..... 439/638, 540.1, 915, 676, 660, 541.5
See application file for complete search history.

(56) References Cited

U.S. PATENT DOCUMENTS

| | | | | |
|---|---|---|---|---|
| 5,244,402 | A | 9/1993 | Pasterchick et al. | |
| 5,415,570 | A | 5/1995 | Sarkissian | |
| 6,244,896 | B1 | 6/2001 | Boutros | |
| 6,468,097 | B1 * | 10/2002 | Bernstein | H01R 13/6485 439/108 |
| 6,488,533 | B1 * | 12/2002 | Thompson | H01R 13/6485 439/188 |
| 6,887,110 | B2 | 5/2005 | Karir | |
| 7,160,143 | B2 * | 1/2007 | David | G01R 31/041 439/489 |
| 7,431,600 | B2 * | 10/2008 | Kozak | H01R 13/502 439/181 |
| 8,579,664 | B1 * | 11/2013 | Schooley | H01R 24/62 439/218 |
| 2011/0012726 | A1 * | 1/2011 | Jessiman | G08B 25/008 340/501 |
| 2011/0115494 | A1 * | 5/2011 | Taylor | H01R 13/514 324/537 |

* cited by examiner

*Primary Examiner* — Tho D Ta
(74) *Attorney, Agent, or Firm* — Patent Capital Group

(57) ABSTRACT

The systems, methods, and apparatuses disclosed herein relate to apparatuses having high density of electrical contacts and/or pins. In some embodiments, an apparatus comprises sets of electrical contacts, and a housing comprising housing portions, each of the housing portions comprising a corresponding planar end that supports a number of the sets of electrical contacts, wherein at least two sets of the sets of electrical contacts are located at different positions measured along a length of the housing. In further embodiments, an apparatus comprises sets of pins, and a housing comprising sets of walls, each of the sets of walls defines a corresponding portion of the elongated cavity, each of the sets of walls supporting a number of sets of the sets of pins, wherein at least two sets of the sets of pins are located at different depths measured along a length of the elongated cavity.

20 Claims, 30 Drawing Sheets

PLUG AND RECEPTACLE HAVING HIGH DENSITY OF ELECTRICAL CONTACTS AND/OR PINS

TECHNICAL FIELD

The present disclosure relates generally to the field of communications and, more particularly, to connectors for use in coupling electronic devices to one another and/or to a network.

BACKGROUND

A data center can store thousands, and in some cases hundreds of thousands, of electronic devices (e.g., servers, routers, switches, etc.) representing one or more networks. Each of the electronic devices can include many receptacles. In the example of a data center, the electronic devices are connected to one another using cables, which include plugs for coupling to the receptacles. The plugs and receptacles may be modular connectors such as: 4 position, 4 contact (4P4C) connectors; 6 position, 6 contact (6P6C) connectors; 8 position, 8 contact (8P8C) connectors; or 10 position, 10 contact (10P10C) connectors. Such a data center can distribute communication signals to a number of other devices connected (e.g., by the network) to a data center. For example, a data center can support a Local Area Network (LAN), a power over Ethernet (PoE) network, a Light as a Service (LaaS) network, the Internet, the Internet of Things (IoT), and/or any other network for distributing data, power, and/or any other signal. PoE networks transmit both electrical power and data on Ethernet cabling. LaaS networks distribute light through a PoE network (e.g., as a subscription service). The IoT is a network connecting multiple objects that are capable of exchanging data between one another over the network. Each object includes embedded electronics to facilitate such data exchanges. Such objects may include wearable devices (e.g., watches, clothing, medical devices), building components (e.g., thermostats, smoke detectors, lighting fixtures, HVAC systems), vehicles, and/or others. Such a data center can utilize connectors to facilitate transmitting data and/or power between the electronic devices.

BRIEF DESCRIPTION OF THE DRAWINGS

To provide a more complete understanding of the present disclosure and features and advantages thereof, reference is made to the following description, taken in conjunction with the accompanying figures, wherein like reference numerals represent like parts, in which:

FIGS. 3A-1, 3A-2, and 3B are simplified diagrams of a modular connection system 300, according to some embodiments of the present disclosure;

FIGS. 4A-1, 4A-2, 4B, 4C, 4D, 4E, and 4F are simplified diagrams of a high density connection system, according to some embodiments of the present disclosure;

DESCRIPTION OF EXAMPLE EMBODIMENTS

Overview

Figure 1A:
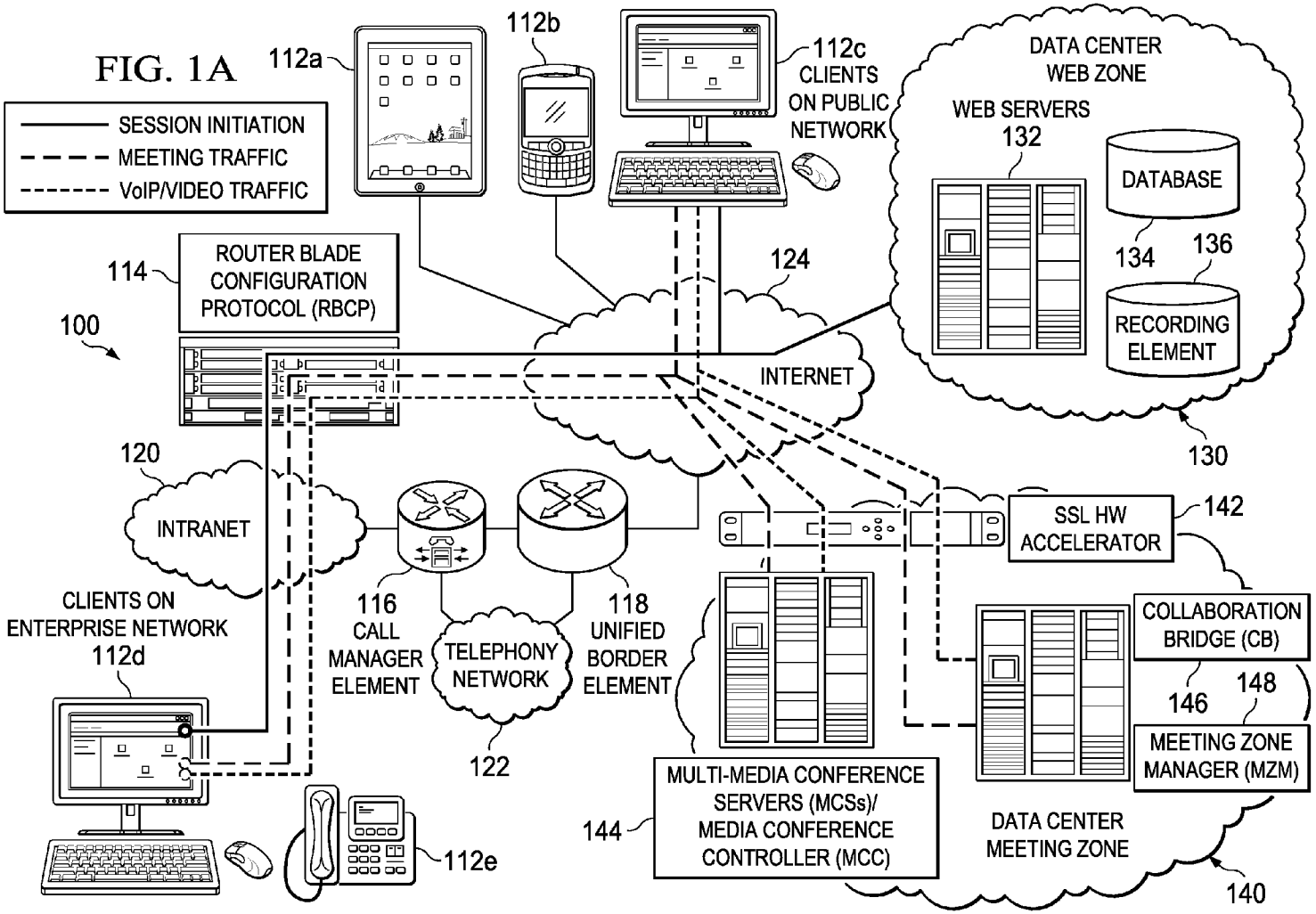
FIG. 1A is a simplified block diagram illustrating a communication system 100 including a plurality of electronic devices in accordance with some embodiments of the present disclosure.

The following examples relate to some embodiments of the present disclosure:

Example 1 is an apparatus (e.g., a plug, male modular connector, and the like) comprising: a housing comprising a first housing portion coupled to a second housing portion; a plurality of sets of electrical contacts supported by the first housing portion, each of the plurality of sets of electrical contacts being located proximate to a first planar end of the first housing portion; an additional set of electrical contacts supported by the second housing portion, the additional set of electrical contacts being located proximate to a second planar end of the second housing portion; and wherein the plurality of sets of electrical contacts and the additional set of electrical contacts are located at different positions, each of the different positions being measured along a length of the housing.

In Example 2, the subject matter of Example 1 can optionally include the plurality of sets of electrical contacts and the additional set of electrical contacts being located at different positions measured along the length of the housing comprising: the first planar end and the second planar end being substantially parallel to one another; each the plurality of sets of electrical contacts being supported by the first planar end at a first distance from an end of the housing; and the additional set of electrical contacts being supported by the second housing portion at a second distance from the end of the housing, and the second distance being larger than the first distance.

In Example 3, the subject matter of any of Examples 1 or 2 can optionally include the plurality of sets of electrical contacts being a first plurality of sets of electrical contacts; and wherein the housing further comprising: a plurality of housing portions, the plurality of housing portions comprising the first housing portion and the second housing portion, each of the plurality of housing portions comprises a corresponding planar end, the first planar end being the corresponding planar end of the first housing portion, and the second planar end being the corresponding planar end of the second housing portion; a second plurality of sets of electrical contacts, the second plurality of sets of electrical contacts comprising the first plurality of sets of electrical contacts and the additional set of electrical contacts; and each of the plurality of housing portions supporting a number of sets of the second plurality of sets of electrical contacts proximate to the corresponding planar end.

In Example 4, the subject matter of any of Examples 1-3 can optionally include the housing progressively narrowing from a first end of the housing to a second end of the housing, the second end of the housing being at an opposite extreme end of the housing relative to the first end of the housing.

In Example 5, the subject matter of any of Examples 1-4 can optionally include the number of sets supported by each of the plurality of housing portions decreases relative to the number of sets supported by an adjacent one of the plurality of housing portions.

In Example 6, the subject matter of any of Examples 1-5 can optionally include a foremost housing portion of the plurality of housing portions is a standard eight-position eight-contact (8P8C) modular plug.

In Example 7, the subject matter of any of Examples 1-6 can optionally include a cable comprising a plurality of wires, wherein each electrical contact in each of the plurality of sets of electrical contacts is electrically coupled to a corresponding one of the plurality of wires.

In Example 8, the subject matter of any of Examples 1-7 can optionally include the first planar end of the first housing portion supporting a larger number of sets of electrical contacts than the second planar end of the second housing portion.

In Example 9, the subject matter of any of Examples 1-8 can optionally include each of the plurality of sets of electrical contacts being positioned about the first housing portion at an angular position relative to an adjacent one of the plurality of sets of electrical contacts.

In Example 10, the subject matter of Example 9 can optionally include the angular position being measured about a longitudinal axis of the housing and/or a center point of the second planar end of the second housing portion.

In Example 11, the subject matter of any of Examples 1-10 can optionally include each of the plurality of sets of electrical contacts and the additional set of electrical contacts being identical to one another or each of the plurality of sets of electrical contacts and the additional set of electrical contacts being different to one another.

In Example 12, the subject matter of Example 11 can optionally include each of the plurality of sets of electrical contacts and the additional set of electrical contacts being identical to one another comprising: spacing between electrical contacts in each of the plurality of sets of electrical contacts and the additional set of electrical contacts match spacing between electrical contacts of an eight-position eight-contact (8P8C) modular plug, and each electrical contact in the plurality of sets of electrical contacts and the additional of set of electrical contacts are substantially identical to one another in physical dimensions (e.g., size, shape, relative spacing of contacts in a particular set).

In Example 13, the subject matter of any of Examples 1-12 can optionally include at least one electrical coupling mechanism coupling each of the plurality of sets of electrical contacts to at least one electrical contact to a wire.

In Example 14, the subject matter of any of Examples 1-13 can optionally include the second housing portion protruding from the first planar end of the first housing portion.

In Example 15, the subject matter of any of Examples 1-14 can optionally include a spring-loaded latch coupled to the first housing portion, the spring-loaded latch being operable to latch a depression within a receptacle in which the apparatus is received and to fix a location of the housing relative to the receptacle.

In Example 16, the subject matter of any of Examples 1-15 can optionally include the first housing portion further comprising a first plurality of side surfaces being perpendicular to the first planar end of the first housing portion; the second housing portion further comprising a second plurality of side surfaces being perpendicular to an second planar end of the second housing portion; and each of the second plurality of side surfaces is recessed relative to a corresponding one of the first plurality of side surfaces.

Example 17 is an apparatus an apparatus (e.g., a receptacle, a socket, a female modular connector, a jack and the like) comprising: a housing comprising a first set of walls and a second set of walls defining an elongated cavity, the first set of walls defining a first portion of the elongated cavity and the second set of walls defining a second portion of the elongated cavity; a plurality of sets of pins supported by the first set of walls, each of the plurality of sets of pins protrudes into the first portion of the elongated cavity; an additional of set of pins supported by one of the second set of walls, the additional of set of pins protrudes into the second portion of the elongated cavity; and wherein the plurality of sets of pins and the additional of set of pins are located at different depths measured along a length of the elongated cavity.

In Example 18, the subject matter of Example 17 can optionally include the plurality of sets of pins and the additional of set of pins being located at different depths measured along the length of the elongated cavity comprising: the additional of set of pins is more deeply recessed into the elongated cavity than the plurality of sets of pins.

In Example 19, the subject matter of any of Examples 17 or 18 can optionally include the plurality of sets of pins and the additional of set of pins being located at different depths measured along the length of the elongated cavity further comprising: each of the plurality of sets of pins is recessed a first depth into the elongated cavity; the additional of set of pins is recessed a second depth into the elongated cavity; and wherein both the first depth and the second depth are measured relative to an open end of the elongated cavity and the second depth is larger than the first depth.

In Example 20, the subject matter of any of Examples 17-19 can optionally include the plurality of sets of pins being a first plurality of sets of pins; and wherein the housing further comprises: a plurality of sets of walls, the plurality of sets of walls comprising the first set of walls and the second set of walls, each of the plurality of sets of walls defines a corresponding portion of the elongated cavity, the first portion of the elongated cavity being the corresponding portion of the elongated cavity associated with the first set of walls, and the second portion of the elongated cavity being the corresponding portion of the elongated cavity associated with the second set of walls; a second plurality of sets of pins supported by the plurality of sets of walls, the second plurality of sets of pins comprising the first plurality of sets of pins and the additional set of pins; and each of the plurality of sets of walls supporting a number of sets of the second plurality of sets of pins, the number of sets of the second plurality of sets of pins protrudes into the corresponding portion of the elongated cavity.

In Example 21, the subject matter of any of Examples 17-20 can optionally include the elongated cavity progressively narrowing from a first end of the housing to a second end of the housing, the second end of the housing being at an opposite extreme end of the housing relative to the first end of the housing.

In Example 22, the subject matter of any of Examples 17-21 can optionally include the number of sets supported by each of the plurality of sets of walls decreasing relative to the number of sets supported by an adjacent one of the plurality of sets of walls.

In Example 23, the subject matter of any of Examples 17-22 can optionally include a foremost portion of the elongated cavity is a standard eight-position eight-contact (8P8C) modular receptacle.

In Example 24, the subject matter of any of Examples 17-23 can optionally include a cable comprising a plurality of wires, wherein each pin in each of the plurality of sets of pins is electrically coupled to a corresponding one of the plurality of wires.

In Example 25, the subject matter of any of Examples 17-24 can optionally include a plurality of leads for coupling the receptacle to a circuit board, wherein each pin in each of the plurality of sets of pins is electrically coupled to a corresponding one of the plurality of leads.

In Example 26, the subject matter of any of Examples 17-25 can optionally include the first set of walls supports a larger number of sets of pins than the second set of walls.

In Example 27, the subject matter of any of Examples 17-26 can optionally include each of the plurality of sets of pins being positioned about the first portion of the elongated cavity at an angular position relative to an adjacent one of the plurality of sets of pins.

In Example 28, the subject matter of Example 27 can optionally include the angular position is measured about a longitudinal axis of the housing and/or a center point of the second portion of the elongated cavity.

In Example 29, the subject matter of any of Examples 17-28 can optionally include each of the plurality of sets of pins and the additional of set of pins being identical to one another.

In Example 30, the subject matter of any of Examples 17-29 can optionally include the each of the plurality of sets of pins and the additional of set of pins being identical to one another comprising: spacing between pins in each of the plurality of sets of pins and the additional of set of pins match spacing between electrical pins of an eight-position eight-contact (8P8C) modular receptacle; and each pin in the plurality of sets of pins and the additional of set of pin are substantially identical to one another in physical dimensions.

In Example 31, the subject matter of any of Examples 17-30 can optionally include at least one electrical coupling mechanism coupling each of the plurality of sets of pins to a wire and/or a circuit board.

In Example 32, the subject matter of any of Examples 17-31 can optionally include the elongated cavity being a stepped socket, the first portion of the elongated cavity is a first step of the stepped socket, the second portion of the elongated cavity is a second step of the stepped socket, the second step being smaller than the first step.

In Example 33, the subject matter of any of Examples 17-32 can optionally include a depression within one of the first set of walls, the depression being operable to receive latching by a latch mechanism, the latch mechanism being coupled to a plug that is inserted into the apparatus.

Example 34 is system comprising: a plug comprising: a plurality of sets of electrical contacts, and a first housing comprising a plurality of housing portions, each of the plurality of housing portions comprising a corresponding planar end, and each of the housing portions supports a number of the plurality of sets of electrical contacts proximate to the corresponding planar end, wherein at least two sets of the plurality of sets of electrical contacts are located at different positions measured along a length of the first housing; and a receptacle comprising: a plurality of sets of pins, and a second housing comprising a plurality of sets of walls, each of the plurality of sets of walls defines a corresponding portion of the elongated cavity, each of the plurality of sets of walls supporting a number of sets of the plurality of sets of pins, the number of sets of the plurality of sets of pins protrudes into the corresponding portion of the elongated cavity, wherein at least two sets of the plurality of sets of pins are located at different depths measured along a length of the elongated cavity.

In Example 35, the subject matter of Example 34 can optionally include a size and a shape of each of the plurality of housing portions of the first housing corresponds to a size and a shape of the corresponding portion of the elongated cavity defined by the each of the plurality of sets of walls and each of the plurality of housing portions fits within the corresponding portion of the elongated cavity.

In Example 36, the subject matter of any of Examples 34 or 35 can optionally include the plug being partially inserted into the receptacle, and each of the plurality of sets of pins simultaneously contacts a corresponding one of the plurality of sets of electrical contacts based, at least in part, on the plug being partially inserted into the receptacle.

In Example 37, the subject matter of any of Examples 34-36 can optionally include the plug further comprising a first cable comprised of a first plurality of wires, wherein each electrical contact in each of the plurality of sets of electrical contacts is electrically coupled to a corresponding one of the first plurality of wires.

In Example 38, the subject matter of any of Examples 34-37 can optionally include the receptacle further comprising a second cable comprised of a second plurality of wires, wherein each pin in each of the plurality of sets of pins is electrically coupled to a corresponding one of the second plurality of wires.

In Example 39, the subject matter of Example 38 can optionally include the each of the plurality of sets of pins simultaneously contacting the corresponding one of the plurality of sets of electrical contacts creates an electrical pathway for bi-directional transmission of signals between the first cable and the second cable.

In Example 40, the subject matter of any of Examples 34-39 can optionally include the receptacle further comprising a plurality of leads for coupling the receptacle to a circuit board, wherein each pin in each of the plurality of sets of pins is electrically coupled to a corresponding one of the plurality of leads.

In Example 41, the subject matter of Example 40 can optionally include the each of the plurality of sets of pins simultaneously contacting the corresponding one of the plurality of sets of electrical contacts creates an electrical pathway for bi-directional transmission of signals between the first cable and the circuit board.

Example 42 is a plug having a high density of electrical contacts, the plug comprising: a plurality of sets of electrical contacts, and a housing comprising a plurality of housing portions, each of the plurality of housing portions comprising a corresponding planar end, and each of the housing portions supports a number of the plurality of sets of electrical contacts proximate to the corresponding planar end, wherein at least two sets of the plurality of sets of electrical contacts are located at different positions measured along a length of the housing.

Example 43 is a receptacle having a high density of pins, the receptacle comprising: a plurality of sets of pins, and a housing comprising a plurality of sets of walls, each of the plurality of sets of walls defines a corresponding portion of the elongated cavity, each of the plurality of sets of walls supporting a number of sets of the plurality of sets of pins, the number of sets of the plurality of sets of pins protrudes into the corresponding portion of the elongated cavity, wherein at least two sets of the plurality of sets of pins are located at different depths measured along a length of the elongated cavity.

EXAMPLE EMBODIMENTS

Electronic devices have limited surface area on which to support receptacles. While the throughput of electronic devices is increasing, the surface area on which to support receptacles is, in some cases, is decreasing (e.g., due to the electronic devices becoming more efficient and smaller). A challenge related to many electronic devices is that a throughput of the devices (e.g., throughput of data, power, and/or any other signal) can be limited by a number of receptacles that each device can support. The throughput of the device, is at least in part, related to a sum of a throughput for each receptacle. However, a surface area of the device limits the total number of receptacles that the device can support. Thus, the throughput of the device is closely related to (and in some cases limited by) the number of receptacles that the device can support. As an extension, a throughput of a data center can be limited by the number of receptacles on each device in the data center. Because many current and future devices (e.g., IoT devices, LaaS devices, PoE devices, network elements, endpoints) place increasing demands on network throughput, such networks may, eventually, need increased throughput to meet the demands.

To address the above issues (and others), a new modular connector (i.e., a high density connector) as disclosed in the present disclosure, includes multiple sets of contacts and/or pins relative to a standard connector. Because each of the sets of contacts/pins is oriented around a housing of the high density connector, the high density connector is relatively comparable in size to a standard connector. Such a high density connector advantageously can provide the throughput of multiple standard connectors while occupying an area only slightly larger than that of a single standard connector. For example, an apparatus may include a plug having a high density of electrical contacts and/or a receptacle having a high density of pins. In some examples, such a plug and a receptacle may be used to establish and maintain (bi-directional) electrical communication between two or more electronic devices (or a source and a destination of an electrical signal).

FIG. 1A is a simplified block diagram illustrating a communication system 100 including a plurality of electronic devices in accordance with some embodiments of the present disclosure. In specific implementations, communication system 100 can be provisioned for use in generating, managing, hosting, and/or otherwise providing data in a network environment. For example, the architecture of communication system 100 is applicable to any type of network technology such as video conferencing architectures (e.g., Telepresence™), web cam configurations, smartphone deployments, personal computing applications (e.g., Skype™) multimedia meeting platforms (e.g., MeetingPlace™, WebEx™, etc.), desktop applications, or any other suitable communication environments.

Communication system 100 may include any number of endpoints 112*a-e* that can achieve suitable network connectivity via various points of attachment. In this particular example, communication system 100 includes an Intranet 120, a telephony network 122, and Internet 124, which (in this particular example) offer a pathway to a data center web zone 130 and a data center meeting zone 140. Telephony network 122 may include, among other things, a voice over Internet protocol (VoIP) gateway and a public switched telephone network (PSTN).

Data center web zone 130 includes a plurality of web servers 132, a database 134, and a recording element 136. Data center meeting zone 140 includes a secure sockets layer hardware (SSL HW) accelerator 142, a plurality of multimedia conference servers (MCSs)/media conference controller (MCC) 144, a collaboration bridge 146, and a meeting zone manager 148. As a general proposition, each MCS can be configured to coordinate data (e.g., video and voice) traffic for a given online communication (e.g., a virtual meeting). Additionally, each MCC can be configured to manage the MCS from data center meeting zone 140.

Note that various types of routers and switches can be used to facilitate communications amongst any of the elements of FIG. 1A. For example, a call manager element 116 and a unified border element 118 can be provisioned between telephony network 122 and Intranet 120. The call manager element is a network manager for IP phones.

Endpoints 112*a-e* represent of any type of client or user wishing to participate in a communication session in communication system 100 (e.g., or in any other virtual platform or online platform). Furthermore, endpoints 112*a-e* can be associated with objects, individuals, clients, customers, or end users wishing to participate in a communication session in communication system 100 via some network. Endpoints 112*a-e* may also be any device that seeks to initiate a communication on behalf of another entity or element, such as a program, a proprietary conferencing device, a database, or any other component, device, element, or object capable of initiating an exchange within communication system 100. Data, as used herein in this document, refers to any type of numeric, voice, video, media, or script data, or any type of source or object code, or any other suitable information in any appropriate format that may be communicated from one point to another. Some devices may receive both data and power over a single cable (e.g., PoE via an Ethernet cable).

FIG. 1A depicts a number of pathways (e.g., shown as solid or broken lines) between the electronic devices (e.g., endpoints and/or network elements) for propagating electrical signals (e.g., data, power, power over Ethernet, meeting traffic, session initiation, voice over Internet protocol (VoIP), video traffic, and/or other electrical signals). The pathways may comprise wired connections, wireless connections, or a combination of wired connections and/or wireless connections. In the example of wired connections, the pathways (or portions thereof) can comprise one or more cables (or series of cables). The cables may include modular connectors at opposite ends of the cable. Such cables may be used to connect the electronic device to a network (e.g., network supplying data, power, power over Ethernet, telephone, and the like) and/or to other devices.

As used herein in this Specification, the term 'endpoint' is inclusive of devices used to initiate a communication, such as a computer, a personal digital assistant (PDA), a laptop or electronic notebook, a cellular telephone of any kind (e.g., a cellular telephone marked under the trade name IPHONE, BLACKBERRY, and/or GOOGLE DROID), an IP phone, a tablet (e.g., an IPAD), an IoT device, a PoE device, a LaaS device, or any other device, component, element, or object capable of initiating voice, audio, video, media, and/or data exchanges within a network. An endpoint may include a suitable interface to a human user, such as a microphone, a display, or a keyboard or other terminal equipment.

In addition, as used herein in this Specification the term 'network element' is meant to encompass any servers (physical or virtual), end user devices, routers, switches, cable boxes, gateways, bridges, loadbalancers, firewalls, inline service nodes, proxies, processors, modules, or any other suitable device, component, element, proprietary appliance, PoE router, PoE switch, or object operable to exchange, receive, and transmit information and/or power in a network environment. These network elements may include any suitable hardware, software, components, modules, interfaces, or objects that facilitate the data communication and power transmission operations thereof. This may be inclusive of appropriate algorithms and communication protocols that allow for the effective exchange of data and/or power.

Figure 1B:
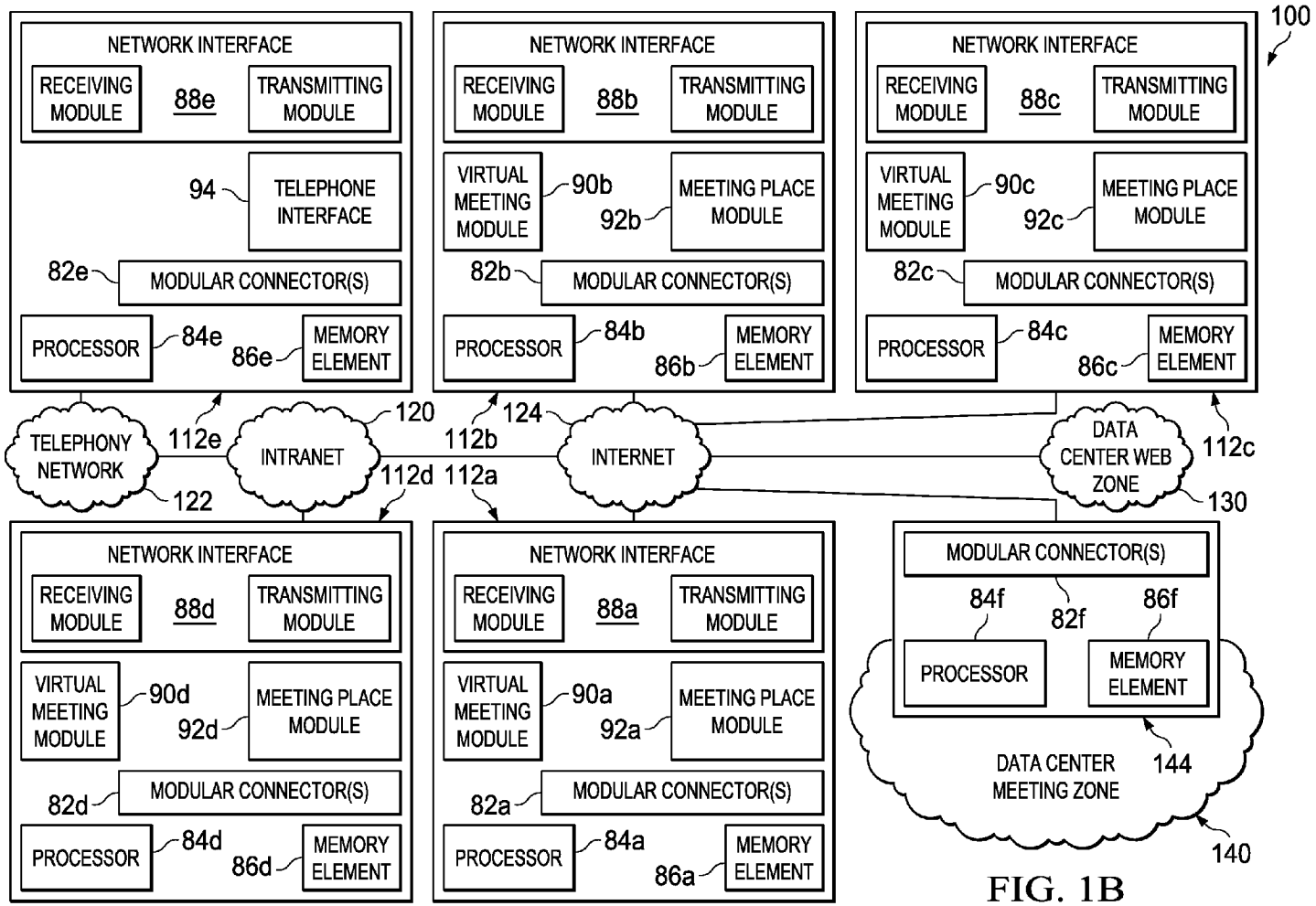
FIG. 1B is a simplified schematic diagram illustrating possible details related to an example infrastructure of the communication system 100 of FIG. 1A, in accordance with some embodiments of the present disclosure.

FIG. 1B is a simplified schematic diagram illustrating possible details related to an example infrastructure of the communication system 100 of FIG. 1A, in accordance with some embodiments. Each of endpoints 112*a-e* are provisioned with a respective modular connectors 82*a-e*, a respective processor 84*a-e*, a respective memory element 86*a-e*, a respective virtual meeting module 90*a-e* (e.g., a virtual meeting application), a respective Meeting Place module 92*a-e*, and a respective network interface 88*a-e*, which includes a respective receiving module and a respective transmitting module for exchanging data (e.g., for exchanging packets in a network environment). Endpoint 112*e* also includes a telephony interface 94 for communicating with telephony network 122. The telephone interface 94 may also include a modular connector (e.g., an Registered Jack (RJ) 11 jack, or any other 4P4C modular connector), for operably connecting the endpoint to a telephony network. Additionally, FIG. 1B illustrates an example implementation of MCSs/MCC 144 that is similarly provisioned with modular connectors 82*f*, a processor 84*f*, and a memory element 86*f*.

In a particular implementation, each endpoint 112*a-e* and/or MCSs/MCC 144 comprises one or more connectors (e.g., one or more high density plugs and/or one or more high density receptacles), as outlined herein in this document. Each connector may include set of pins and/or electrical contact where each set can have a different layout (e.g., 4P4C, 6P6C, 8P8C layouts). For example, a single connector may include a first set of pins in a 4P4C layout and a second set of pins in an 8P8C layout (e.g., a high density connector as disclosed herein). Likewise a single connector may include a first set of electrical contacts in a 4P4C layout and a second set of electrical contacts in an 8P8C layout.

Each of an electrical contact and a pin are inclusive of an electrically conductive material operable to transmit electrical current to another electrical contact or pin (as the case may be) when the two contact one another. The terms 'electrical contact' and 'contact' are used interchangeably in the present disclosure. The term 'pin' is used in connection with contacts on a receptacle. The terms 'electrical contact' and 'contact' are used in connection with contacts on a plug.

Figure 1C:
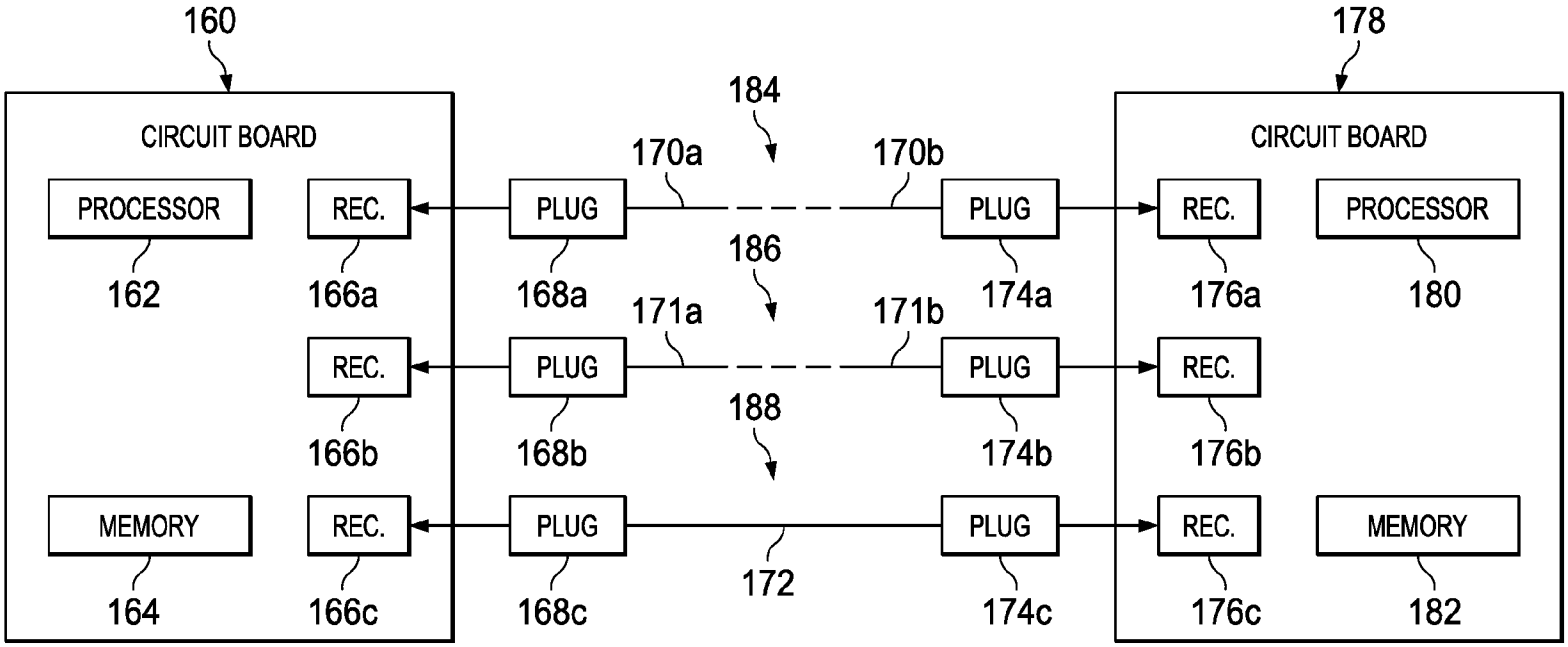
FIG. 1C illustrates a detail of two circuit boards coupled to one another by connectors, according to some embodiments of the present disclosure.

The endpoints, network elements, PoE devices, IoT device, and other electronic devices described in the present disclosure may include one or more circuit boards. For example, FIG. 1C illustrates a detail of circuit boards 160 and 178, according to some embodiments of the present disclosure. Each of the circuit boards 160 and 178 may be in a different electronic device. In a specific implementation, each of the circuit boards 160 and 178 is in a different one of the devices of system 100 of FIGS. 1A and 1B. For example, the circuit board 160 may be located in a first multi-media conference server (MCS) and the circuit board 178 may be located in a second MCS (in the MCSs 144). In still other implementations, the circuit board 160 is located in a PoE power sourcing equipment (PSE) (e.g., a PoE switch for providing LaaS over a PoE network) and the circuit board 178 is located in a PoE powered device (PD) (e.g., a LaaS PD operable to receive power and/or data from the PSE).

In FIG. 1C, the circuit board 160 comprises a processor 162, a memory element 164, and receptacles 166*a*, 166*b*, and 166*c*; and the circuit board 178 comprises a processor 180, memory element 182, and receptacles 176*a*, 176*b*, and 176*c*. Each circuit board may further include a data bus that operably couples each of the components on the circuit board to one another and, thereby, enables signals to be transferred (e.g., transmission and reception) between the components. Each of the receptacles 166*a*, 166*b*, 166*c*, 176*a*, 176*b*, and 176*c* includes at least one set of pins and at least one set of electrical leads (i.e., leads or lead wires). Each pin in each of the at least one set of pins is electrically coupled to a corresponding lead in the at least one set of leads to provide a pathway for signals to pass through the receptacle. Each of the circuit boards 160 and 178 may further include other components (e.g., hardware and/or software) that are not illustrated in the Figure only for simplicity of the drawings.

Electrical leads (i.e., leads or lead wires) operably couple each receptacle to the circuit board. In particular, the lead may make electrical contact with the data bus and, thereby, communicably couple the receptacle to other components present on the circuit board. Within each receptacle, an electrical lead coupled to one or more pins present on the receptacle.

A circuit board may be directly or indirectly connected to one another circuit board by cables. In the example illustrated in FIG. 1C, circuit boards 160 and 178 are coupled to one another by cables 184, 186, and 188. Cables 184 and 186 indirectly couple the circuit boards 160 and 178; cable 188 directly couples the circuit boards 160 and 178. Each cable includes a plug at each end coupled by wires. The cable 184 comprises plug 168*a*, plug 174*a*, and wires 170 (i.e., sections of wiring 170*a* and 170*b*). The cable 186 comprises plug 168*b*, plug 174*b*, and wires 171 (i.e., sections of wiring 171*a* and 171*b*). The cable 188 comprises plug 168*c*, plug 174*c*, and wires 172. Electrical signals (e.g., data and/or power) travel through the wires between the plugs (i.e., the wires provide an electrical pathway). Each plug can be inserted (as indicated by the arrows in FIG. 1C) into a corresponding receptacle to make electrical contact between pins (in the receptacle) and electrical contacts (in the plug).

The cables are not limited to having only a single plug at each end. FIG. 1C illustrates each cable including a single plug at each end only for simplicity of the drawings. In other examples, a cable may include one or more plugs at each end. For each cable (or set of cables), the plug at each end of the cable may be any of the plugs disclosed herein (as discussed further below). In a particular implementation, a cable has multiple plugs on one end and a single plug at an opposite end (e.g., an "octopus" cable). A cable (e.g., any one or more of the cables 184, 186, and 188) may have at a first end (e.g., plug 168*c*) that comprises several standard modular plug connectors (e.g., a standard 8P8C plug, a standard 4P4C plug, and the like) and a second end that comprises a single plug having a high density of contacts (e.g., a high density plug). For example, one end of the cable is broken out into multiple individual wiring sets that each connect to a standard 8P8C plug (e.g., five plugs, each like that discussed below with reference to FIG. 3A-1) and, at another end of the cable, the multiple individual wiring sets are connected to a high density plug (e.g., a plug like the plug 402 discussed below with reference to FIG. 4A-1). In such an example, one end of the cable includes multiple plugs (each of which are operable to couple to a separate receptacle) and the other end of the cable includes a single high density plug (which is operable to couple to a single high density receptacle). Between the two ends of the cable the individual wiring sets (e.g., wires corresponding to a standard cable) may be bound together to form a single cable (e.g., a cable comprising multiple cables), which extends to the high density plug. The cable may include more wires that a standard cable to accommodate providing electrical connections between each of the multiple plugs and the high-density plug. Thus, the cable may be larger (e.g., a larger diameter and/or an increased weight) than such a standard cable.

In operation, the circuit boards 160 and 178 (e.g., using the corresponding processors) transfer signals between one another. For example, the processors 162 and 180 (located on circuit boards 160 and 178, respectively) access and/or modify data stored in the memory elements 164 and 182 and further utilize the receptacles to transmit signals between one another (and/or to circuit boards location on other electronic devices). The circuit boards may directly transmit signals between one another and/or indirectly transmit signals between one another (e.g., over a network of other devices). The circuit boards directly transmitting signals between one another may comprise direct, wired connections between devices. Such a connection can comprise any one or more of the following: a cable that directly connects two or more electronic devices that are located in the same data center, a cable that directly connects two or more endpoints in the same room, and/or connections where no other networks or devices lie between the connected devices, and the like. In the example of FIG. 1C, the wire 172 (of cable 188) corresponds to a direct, wired connection between the circuit boards 160 and 178. The circuit boards indirectly transmitting signals between one another may comprise a series of connections (e.g., wired and/or wireless connections) between devices. Such a series of connections may include other devices and/or networks (e.g., WAN, LAN, Internet, etc.) that lie between the circuit boards. In the example of FIG. 1C, the wires illustrated with a dashed line correspond to indirect connections between the circuit boards 160 and 178. A first section of wiring 170*a* and a second section of wiring 170*b* are indirect connections between the circuit boards 160 and 178 and are illustrated as dashed lines in the FIG. 1C. In one example, a switch (e.g., a PoE switch) is located between the first section of wiring 170*a* and the second section of wiring 170*b*. In such an example, the processor 162 may transmit signals (e.g., data and/or power) to the switch over the cable 184. While in transit from the circuit board 160 to the switch, the signal first traverses receptacle 166*a*, next traverses the plug 168*a*, followed by first section of wiring 170*a*, and finally reaches the switch. As another example, the switch may make a determination to transmit a signal to an address that identifies (or otherwise corresponds to) the processor 180 on the circuit board 178. The switch may then transmit the signal over the second section of wiring 170*b* to the circuit board 178. While in transit from the switch to the circuit board 178, the signal first traverses the second section of wiring 170*b*, next traverses the plug 174*a*, followed by receptacle 176*a*, and finally reaches the processor 180. Signals may be transmitted in either direction over the cables. Signals may be transmitted over cable 186 and 188 in a manner similar to that described for cable 184.

Figures 1, 2A:
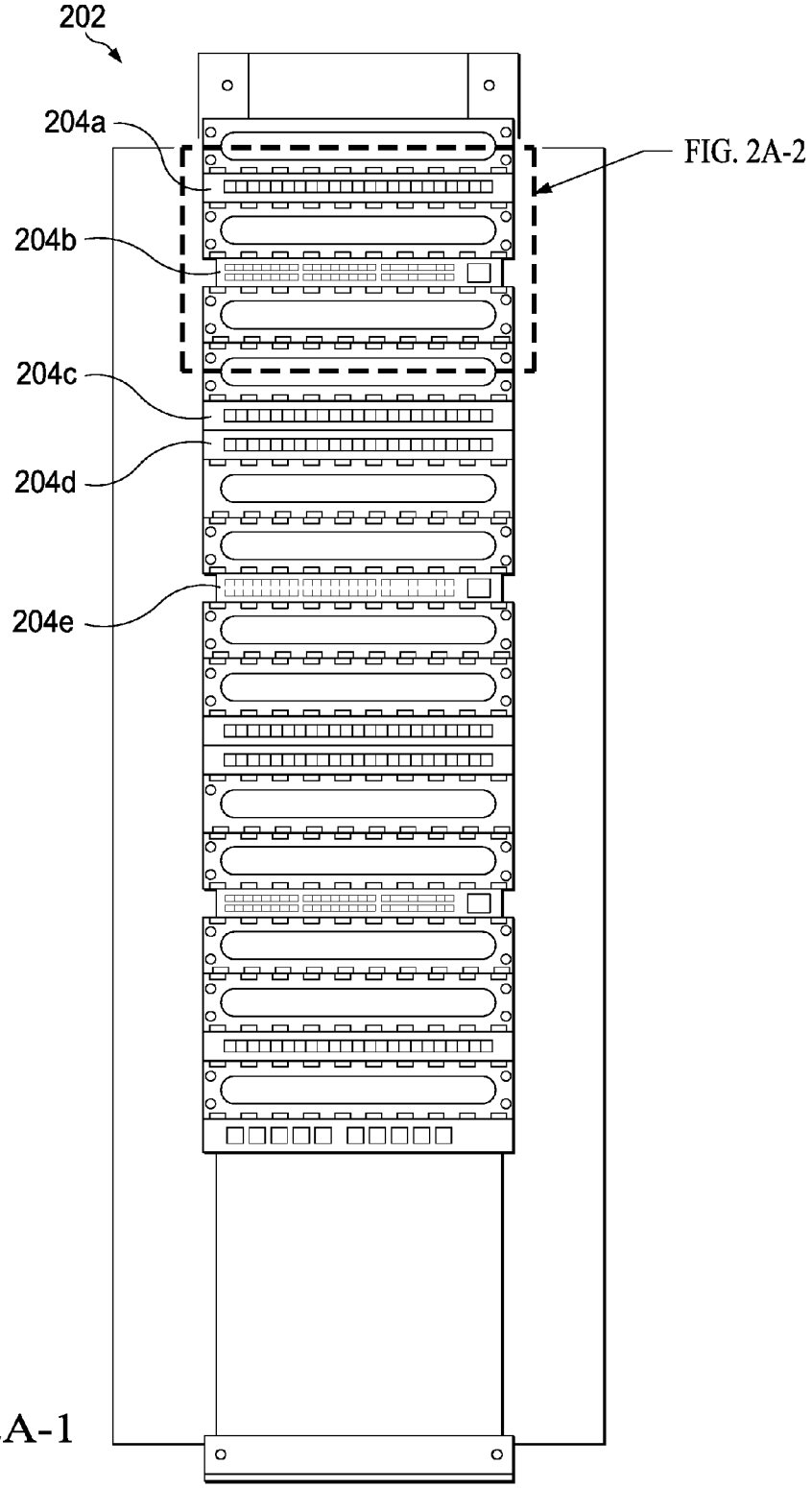
FIGS. 2A-1, 2A-2, 2B-1, 2B-2 illustrate receptacles in various network elements.
Figures 2, 2A:
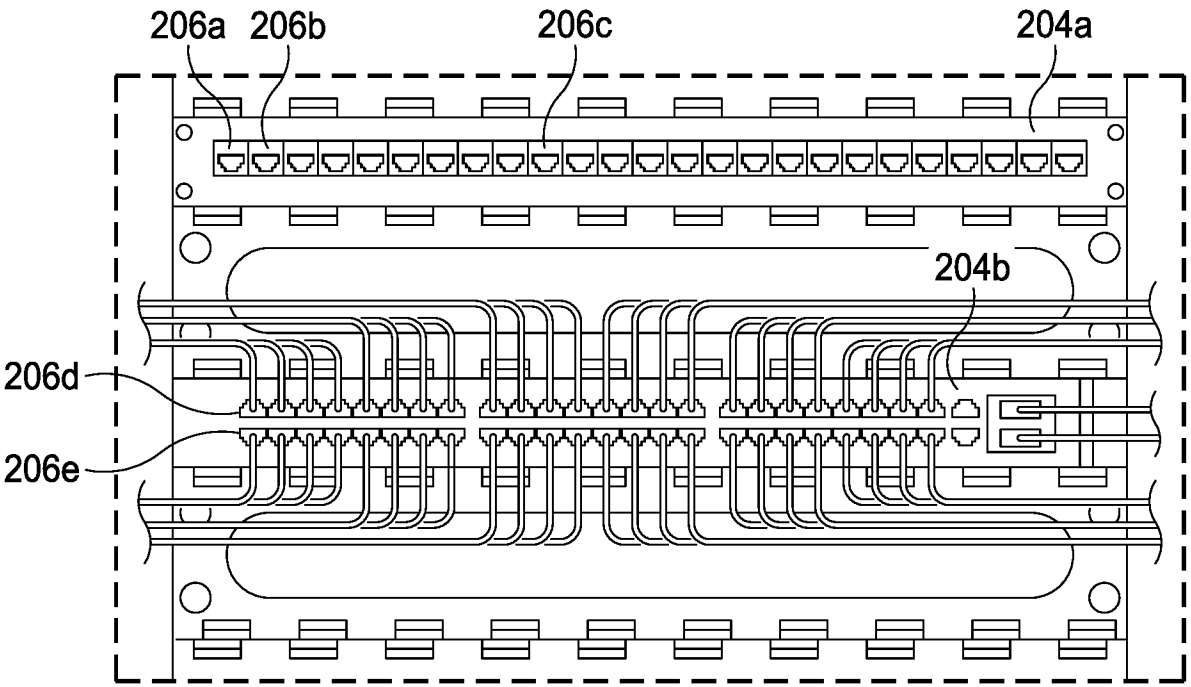
Figures 2, 2B:
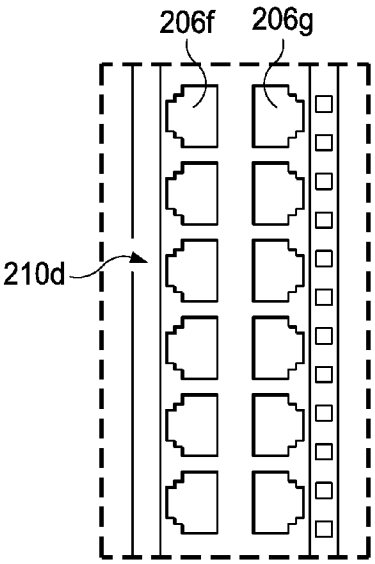
Figures 1, 2B:
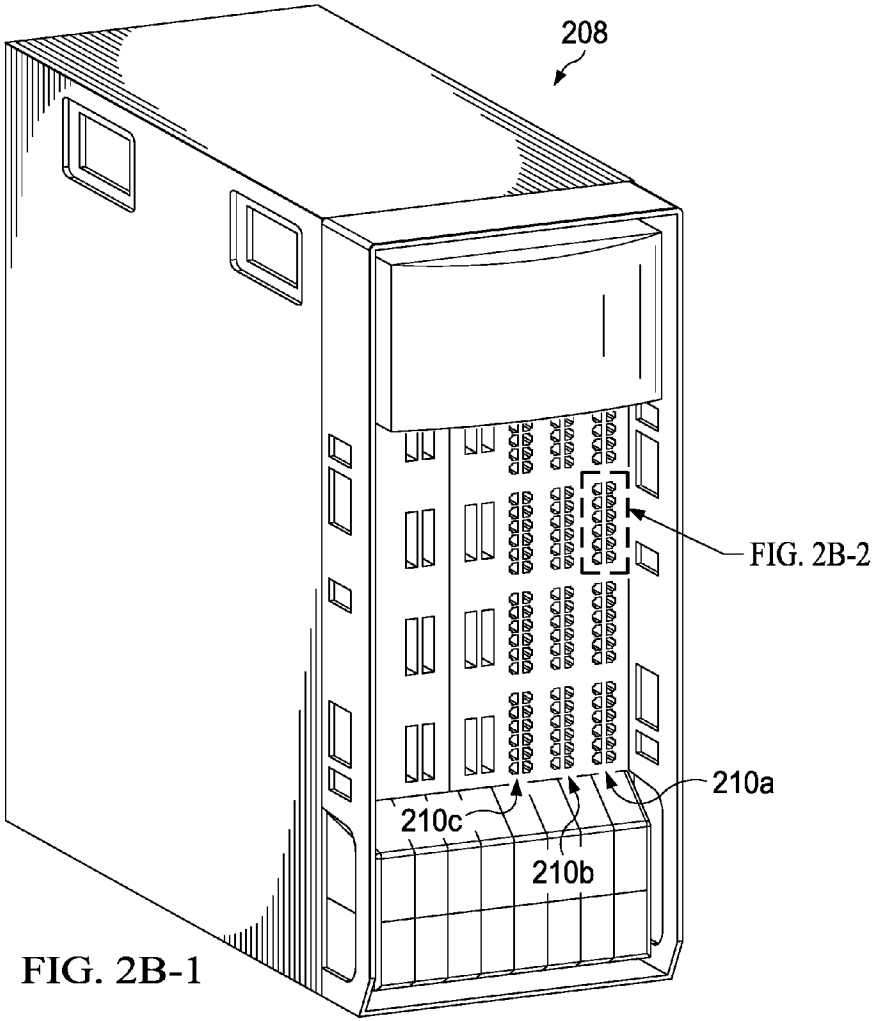

FIGS. 2A-1, 2A-2, 2B-1, 2B-2 illustrate receptacles in various network elements. FIG. 2A-1 illustrates rack 202 storing several network elements, each of which contains many receptacles. FIG. 2A-2 is a detailed view of the receptacles in some of the network elements in the rack 202 of FIG. 2A-1. FIG. 2B-1 illustrates a network element 208, which includes many receptacles. FIG. 2B-2 is a detailed view of the receptacles located on the network element 208 of FIG. 2B-1.

Turning to FIG. 2A-1, the rack 202 supports many electronic devices 204*a*, 204*b*, 204*c*, 204*d*, and 204*e*. In some implementations, a data center (e.g., data center 130 and/or data center 140) may include a plurality of electronic devices and a plurality of racks (each similar to 202) in which to store the electronic devices. In this example, at least some of the electronic devices are servers while others are switches. Each of the electronic devices includes a plurality of receptacles. Each of the receptacles occupies a certain surface area on an exterior surface of the electronic devices (e.g., the area of an opening in the exterior of the electronic device in which the receptacle is located). The dashed rectangular area in FIG. 2A-1 labeled 'FIG. 2A-2' illustrates the area shown in detail in FIG. 2A-2.

Turning to FIG. 2A-2, FIG. 2A-2 is a detail of the receptacles in the devices 204*a* and 204*b*. The device 204*a* includes, among other receptacles, receptacles 206*a*, 206*b*, and 206*c*. The receptacles 206*a*, 206*b*, and 206*c* are coupled to one or more circuit boards within the device 204*a* (e.g., similar to circuit boards 160 and/or 178 of FIG. 1C). The device 204*b* includes, among other receptacles, receptacles 206*d* and 206*e*. The receptacles 206*d* and 206*e* are coupled to one or more circuit boards within the device 204*b* (e.g., similar to circuit boards 160 and/or 178 of FIG. 1C). Each of the receptacles 206*d* and 206*e* has a plug inserted therein, where the plug is connected at the end of a cable. No such plug is inserted into the receptacles 206*a*, 206*b*, and 206*c*. Each of the receptacles 206*a*, 206*b*, 206*c*, 206*d*, and 206*e* is a standard receptacle.

Turning to FIG. 2B-1, the electronic device 208 includes a plurality of sets of receptacles 210*a*, 210*b*, 210*c*, and 210*d*. The electronic device 208 is a switch (e.g., an ISP switch, a PoE switch, or any other switch). In some implementations, a data center (e.g., data center 130 and/or data center 140 of FIG. 1A) may include a plurality of such switches. Each receptacle in the sets of the receptacles occupies a certain surface area on an exterior surface of the switch (e.g., the area of an opening in the exterior of the electronic device in which the receptacle is located). The dashed rectangular area in FIG. 2B-1 labeled 'FIG. 2B-2' illustrates the area shown in detail in FIG. 2B-2.

Turning to FIG. 2B-2, FIG. 2B-2 is a detail of a set of receptacles 210*d* in the devices 208. The set of receptacles 210*d* includes, among other receptacles, receptacles 206*f* and 206*g*. The receptacles 206*f* and 206*g* are coupled to one or more circuit boards within the device 208 (e.g., similar to circuit boards 160 and/or 178 of FIG. 1A). Each of the receptacles in each of the sets of receptacles 210*a-d* is a standard receptacle.

A challenge related to the electronic devices 204*a*, 204*b*, 204*c*, 204*d*, and 204*e* (of FIGS. 2A-1 and 2A-2) and the electronic device 208 (of FIGS. 2B-1 and 2B-2) is that one factor that limits the throughput of the electronic devices is the number of receptacles that each electronic device can support. The throughput of the electronic device, is at least in part, related to a sum of throughput for each receptacle. However, the surface area available on the electronic device limits the total number of receptacles. Thus, the throughput of the electronic devices is closely related to (and in some cases limited by) the number of receptacles that each device can support.

To address the above issues (and others), a high density connector, as disclosed in the present disclosure, includes multiple sets of contacts and/or pins relative to a standard plug. Each of the sets of contacts is oriented around a housing of the connector (e.g., to maintain a relatively small oversize of the connector). Such a high density connector advantageously can provide the throughput of multiple standard connector while occupying an area only slightly larger than that of a single standard connector.

In an implementation of such a solution, a high density receptacle (as disclosed herein) replaces multiples of the standard receptacles 206*a-e* (of FIGS. 2A-1 and 2A-2). For example, a single high density receptacle (as disclosed herein) replaces five of the standard receptacles 206*a-e*. Such a high density receptacle advantageously occupies an area only slightly larger than that of a single standard receptacle. In addition, a high density plug (as disclosed herein) replaces multiples of the standard plugs. For example, a single high density plug (as disclosed herein) replaces five standard plugs (e.g., as plugged into the receptacles 206*d-e*). Indeed, when a high density receptacle replaces each of the receptacles on an electronic device, the overall throughput available to the electronic device via the cables increase multiple times over. Similar replacements and increases in throughput are achieved by replacing the standard receptacles 206*f-g* (of FIGS. 2B-1 and 2B-2) with high density receptacles.

Figures 1, 3A:
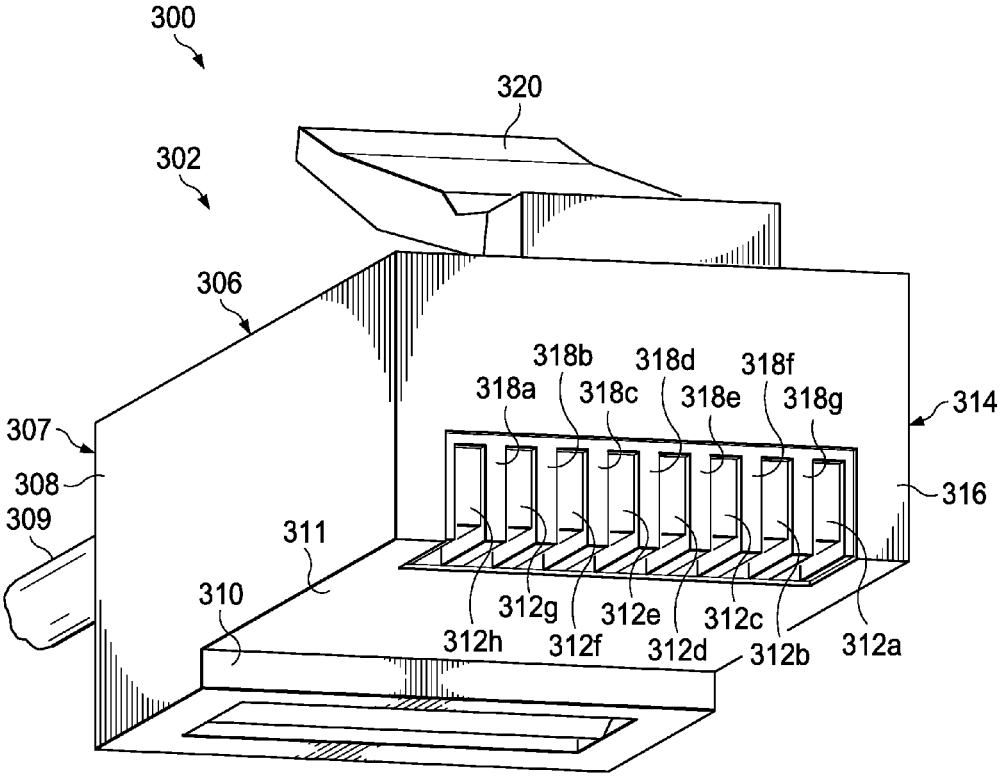
Figures 2, 3A:
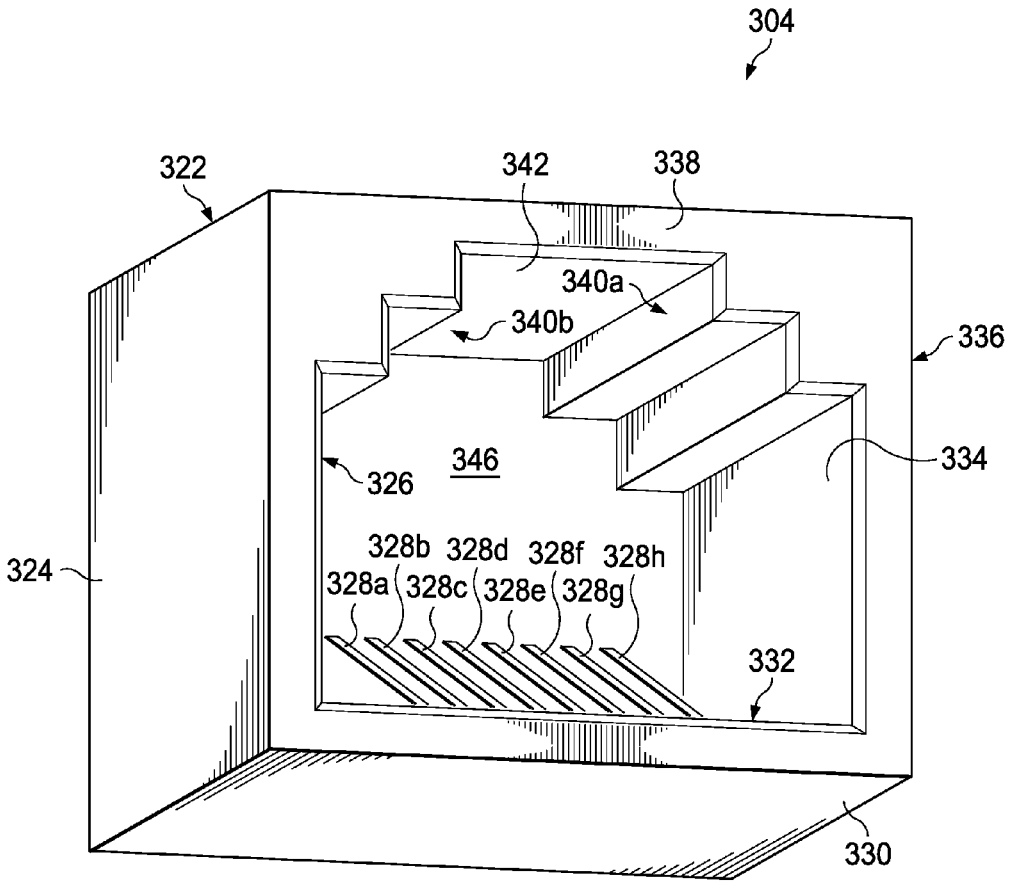
Figure 3B:
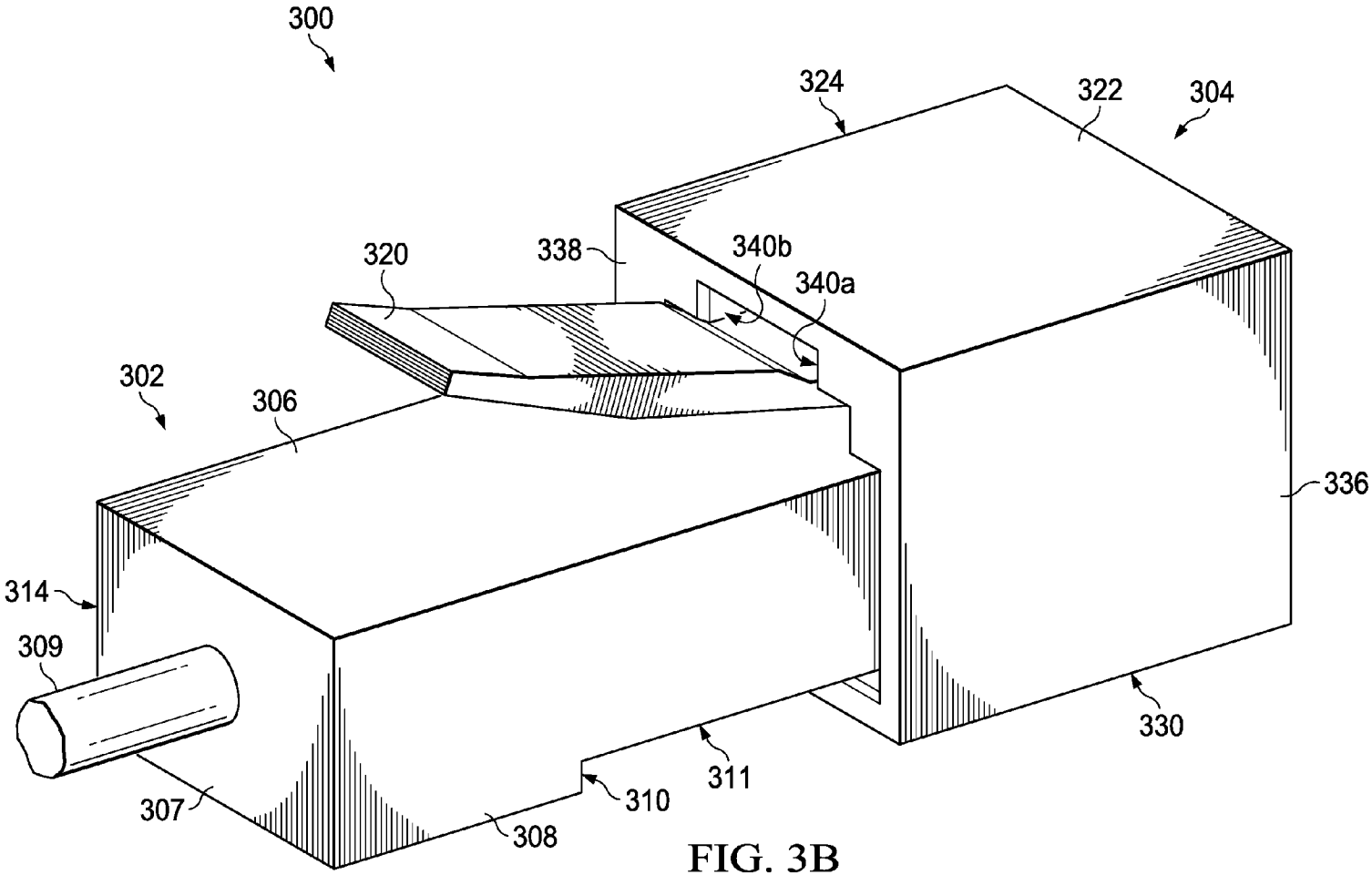

FIGS. 3A-1, 3A-2, and 3B illustrate a modular connection system 300 according to some embodiments of the present disclosure. The modular connection system is a standardized 8P8C connector system including a plug and a receptacle. FIG. 3A-1 is a three-dimensional isometric view of a standardized 8P8C plug 302. FIG. 3A-2 is a three-dimensional isometric view a receptacle 304 (i.e., a standardized receptacle), which corresponds to the standardized 8P8C plug 302 (i.e., a standard 8P8C receptacle). FIG. 3B is a three-dimensional isometric view of the plug 302 and the receptacle 304 partially engaged with one another.

As used herein in this Specification, the term 'modular connector' is inclusive of a male connector (e.g., a plug) and/or a female connector (e.g., a receptacle, a port, a socket). A male connector can be inserted into a corresponding female connector to selectively establish (and maintain) an electrical connection between the respective connectors. A modular connector includes a number of positions (N) in which to place (M) number of contacts (or pins) (i.e., an N position, M contact modular connector where each of N and M is an integer greater than zero and N is greater than or equal to M). As an example, a modular connector may include four, six, eight, or 10 positions (or any other number). Each position may (or may not) be filled by a contact. For example, a connector may have six positions and four contacts (6P4C). In other examples, a modular connector includes an equal number of positions and contacts (e.g., each following the basic form of XPXC, where X is an integer greater than zero). For example, each of the following modular connector types includes an equal number of positions and contacts: 4 position, 4 contact (4P4C); 6 position, 6 contact (6P6C); 8 position, 8 contact (8P8C); and 10 position, 10 contact (10P10C). Each contact can be connected to a wire in a cable. In some examples, each contact is connected to a different wire (e.g., the number of wires in the cable is equal to the number of contacts). In other examples, two or more contacts are connected to a single wire (e.g., the number of wires in the cable is less than the number of contacts).

A modular connector may implement characteristics of a standards document (i.e., a 'standardized' or 'standard' modular connector). As an example, the International Electrotechnical Commission (IEC) publishes standards document IEC 60603, which specifies details for 8-way connectors in parts 7-1, 7-2, 7-3, 7-4, 7-5, and 7-7. Each of IEC 60603 parts 7-1 (edition 3.0, published in 2011), 7-2 (edition 2.0, published in 2010), 7-3 (edition 2.0, published in 2010), 7-4 (edition 2.0, published in 2010), 7-5 (edition 2.0, published in 2010), and 7-7 (edition 3.0, published in 2010) are specific versions of parts of IEC 60603 published by the IEC. 8-way connectors correspond to 8P8C connectors as described herein. An 8P8C modular connector (or a layout of contacts and/or pins, a 8P8C layout) may be an 8-way connector (or 8-way layout of contacts and/or pins) implementing physical dimensions, mechanical characteristics, and electrical characteristics as defined in any one or more of the parts (or portions thereof).

Turning to FIG. 3A-1, the plug 302 includes a housing, a latch 320 extending from a top of the housing, a cable 309 extending from a rear of the housing, and electrical contacts 312*a-h*. The housing is rectangular in general shape and includes several exterior surfaces comprising top surface 306, side surfaces 314 and 308, bottom surface 311, front surface 316, and rear surface 307. Each of the exterior surfaces is approximately perpendicular to adjacent surfaces and, therefore, has right angles at edges of the housing. A stopper 310 projects from the bottom surface 311. The housing supports the latch 320 at the top surface 306. The latch 320 is connected to the housing at a front portion of the latch; a rear portion of the latch is free and extends, at an angle, outwardly away from the top surface 306.

The plug 302 is operable to be selectively engaged with (or disengaged from) a corresponding receptacle. Several features facilitate the plug being engaged with (or disengaged from) such a receptacle. For example, the latch 320 can fasten the plug to a receptacle and the stopper 310 can control a depth at which the plug can be inserted into the receptacle. A latch can fasten the plug to the receptacle by fixing a location of the plug relative to the receptacle. A latch operates in a spring-like manner (so called 'spring-loaded' latch) to engage a depression within the receptacle. When a force is applied to the free end of the latch, the free end moves downward (toward the top surface) and, thereby, causes the latch to deflect. When the force is released, the free end of the latch moves upward (away from the top surface) thereby causing the latch to unload and return to an undeflected shape. The latch transitioning between deflected and undeflected shape provide the spring-like feature for selectively engaging the depression and, thereby, selectively attaching the plug and receptacle. As the plug is advanced into the receptacle, the depression applies a force to the latch and thereby, deflecting the latch when the plug is engaged in the receptacle. The stopper 310 can control a depth at which the plug can be inserted into the receptacle by contacting a surface of the receptacle. In effect, the stopper prevents the plug from being advanced too deeply into the receptacle, which can damage the plug and/or receptacle. The stopper reduces the likelihood of such damage.

The set of contacts 312*a-h* straddles an apparent edge that lies at the intersection of the front surface 316 and the bottom surface 311 of the housing. The contacts are supported adjacent the front surface 316 and the bottom surface 311 of the housing. Each of the contacts 312*a-h* is made of an electrically conductive material (e.g., metal, copper, and the like). Spacers 318*a-g*, at least in part, define positions in which the contacts lie. The spacers may be made of an electrically insulating material (e.g., to prevent signals received at each contact from being erroneously received at an adjacent contact). The plug is an 8P8C connector and has 7 spacers, which separate the 8 positions. The cable 309 includes wires bound together to form a single cable. Each of the contacts 312*a-h* is connected to a wire in the cable 309. The cable extends from the rear surface 307 of the housing. In some specific implementations, the cable is a twisted-pair cable (e.g., an Ethernet cable transmitting data and/or power).

Turning to FIG. 3A-2, the receptacle 304 includes a housing and a set of electrical pins 328*a-h*. The housing is rectangular in general shape and includes several walls (i.e., a top, a bottom, and two side walls), each of which has an interior surface and an exterior surface. The walls include a first side wall (i.e. interior surface 334, exterior surface 336), a second side wall (i.e. interior surface 326, exterior surface 324), a bottom wall (i.e. interior surface 332, exterior surface 330), a top wall (i.e. interior surface (not labeled), exterior surface 322), and a rear wall (interior surface 346, exterior surface (not shown)). Each wall is approximately perpendicular to adjacent walls and, therefore, has right angles at edges of the housing. The housing includes a depression 342 comprising a series of stepped portions 340*a* and 340*b*, each of which is adjacent the top wall. The walls define a cavity in which to receive a plug. Each of the pins 328*a-h* is connected to a wire (not shown) and/or a lead (not shown). For example, a cable (e.g., including wires bound together to form a single cable) may extend from the rear wall of the housing. In some specific implementations, the cable is a twisted-pair cable (e.g., an Ethernet cable transmitting data and/or power). In other implementations, a set of leads (e.g., for coupling the receptacle to a circuit board) may from the rear wall of the housing.

The receptacle 304 (of FIG. 3A-2) corresponds to the 8P8C plug 302 (of FIG. 3A-1) and, therefore, includes 8 pins. The location of the pins 328*a-h* on the receptacle 304 corresponds to the location of the contacts 312*a-h* on the plug 302. The electrical pins 328*a-h* are supported adjacent a front end of the bottom wall. Each pin (in each of the sets of electrical pins 328*a-h*) protrudes into the cavity created by the walls. Each pin cantilevers into the housing at a front portion of the bottom wall. Each pin extends, at an angle, toward the rear wall 346. Each of the pins 328*a-h* is made of an electrically conductive material (e.g., metal, copper, and the like).

Turning to FIG. 3B, FIG. 3B illustrates the plug 302 and the receptacle 304 partially engaged with one another. Because the location of the pins 328*a-h* on the receptacle 304 corresponds to the location of the contacts 312*a-h* on the plug 302, the pins 328*a-h* make physical contact with the contacts 312*a-h* when the plug 302 is inserted in the receptacle 304. In FIG. 3B, the plug 302 and the receptacle 304 are shown in a state when the contacts 312*a-h* and the pins 328*a-h* make initial contact with one another (when inserting). While the contacts 312*a-h* and the pins 328*a-h* remain in contact with one another, signals can be bi-directionally transferred between the contacts 312*a-h* and the pins 328*a-h*. When the plug is further advanced into the cavity of the receptacle, the stopper 310 contacts the front surface 338 and the latch 320 engages the depression 342 (i.e. adjacent stepped portions 340*a* and 340*b*). The latch 320 being engaged in the depression 342 fixes the location of the plug 302 relative to the receptacle 304 and substantially prevents the plug 302 disengaging the receptacle 304. The plug 302 can selectively engaged with (or disengaged from) a receptacle 304. When engaged, the latch may be pressed downward to disengage the depression 342 and, thereby, enables the plug 302 to move freely for removal from the receptacle 304.

Figures 1, 4A:
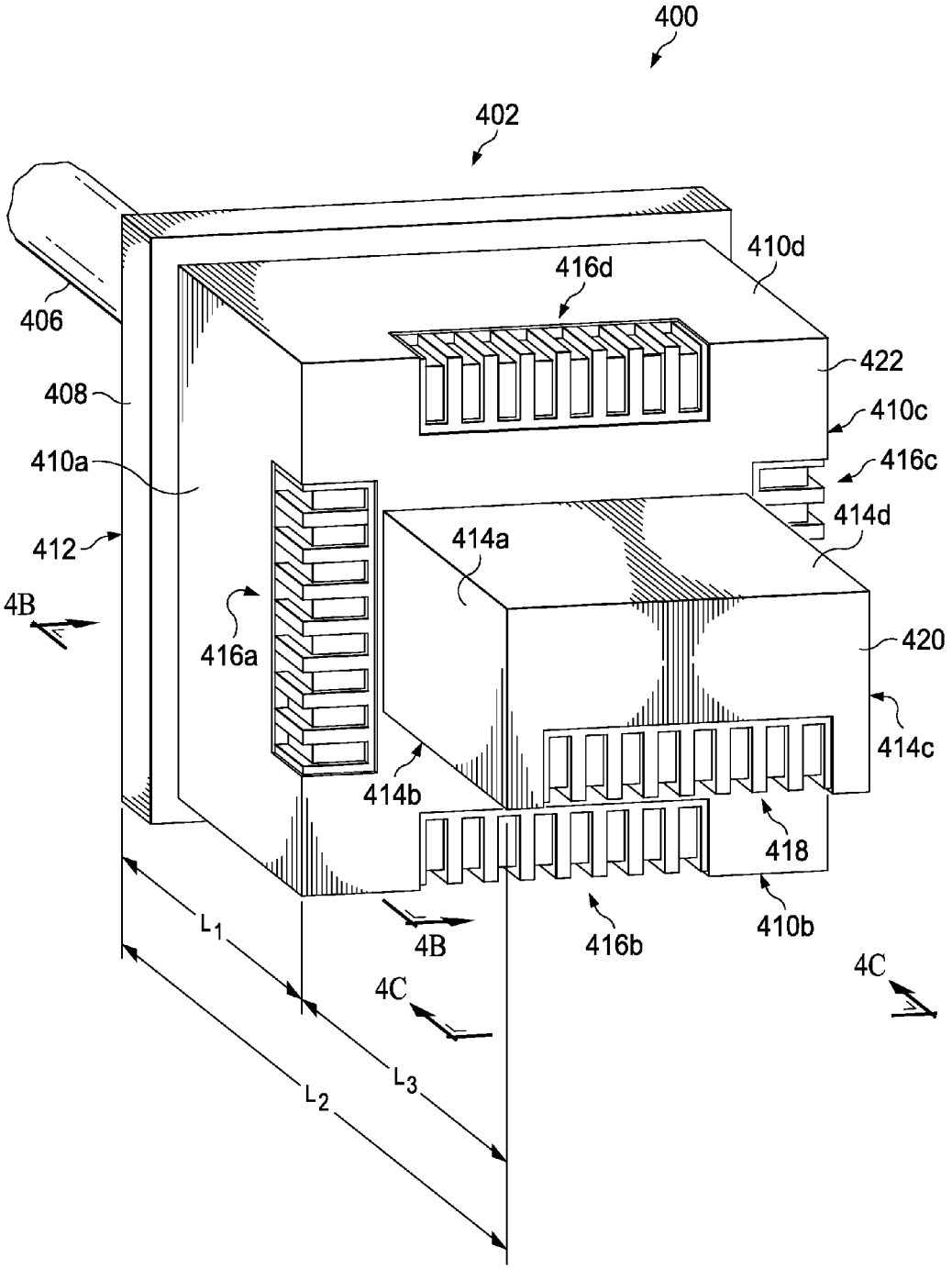
Figures 2, 4A:
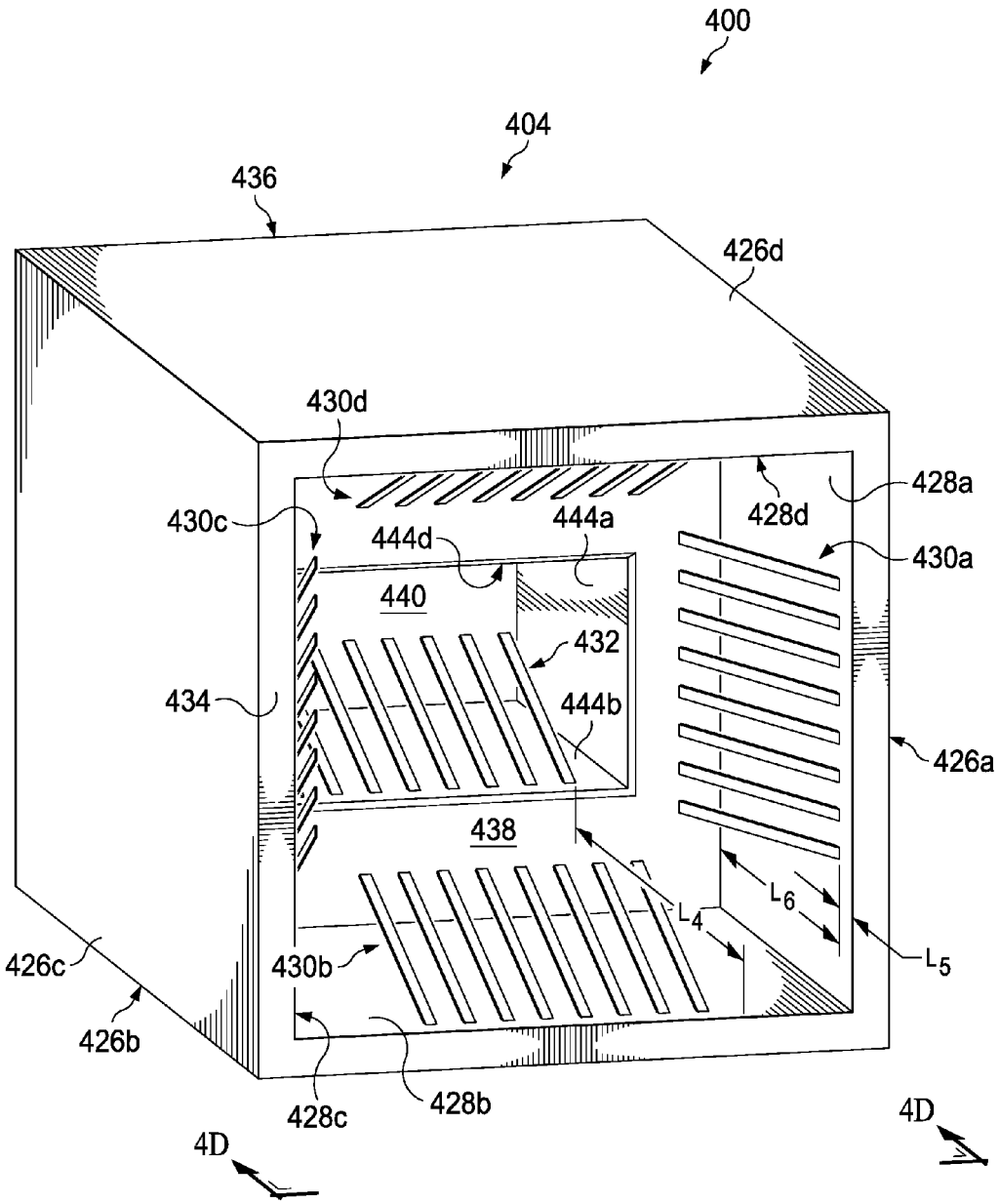
Figure 4B:
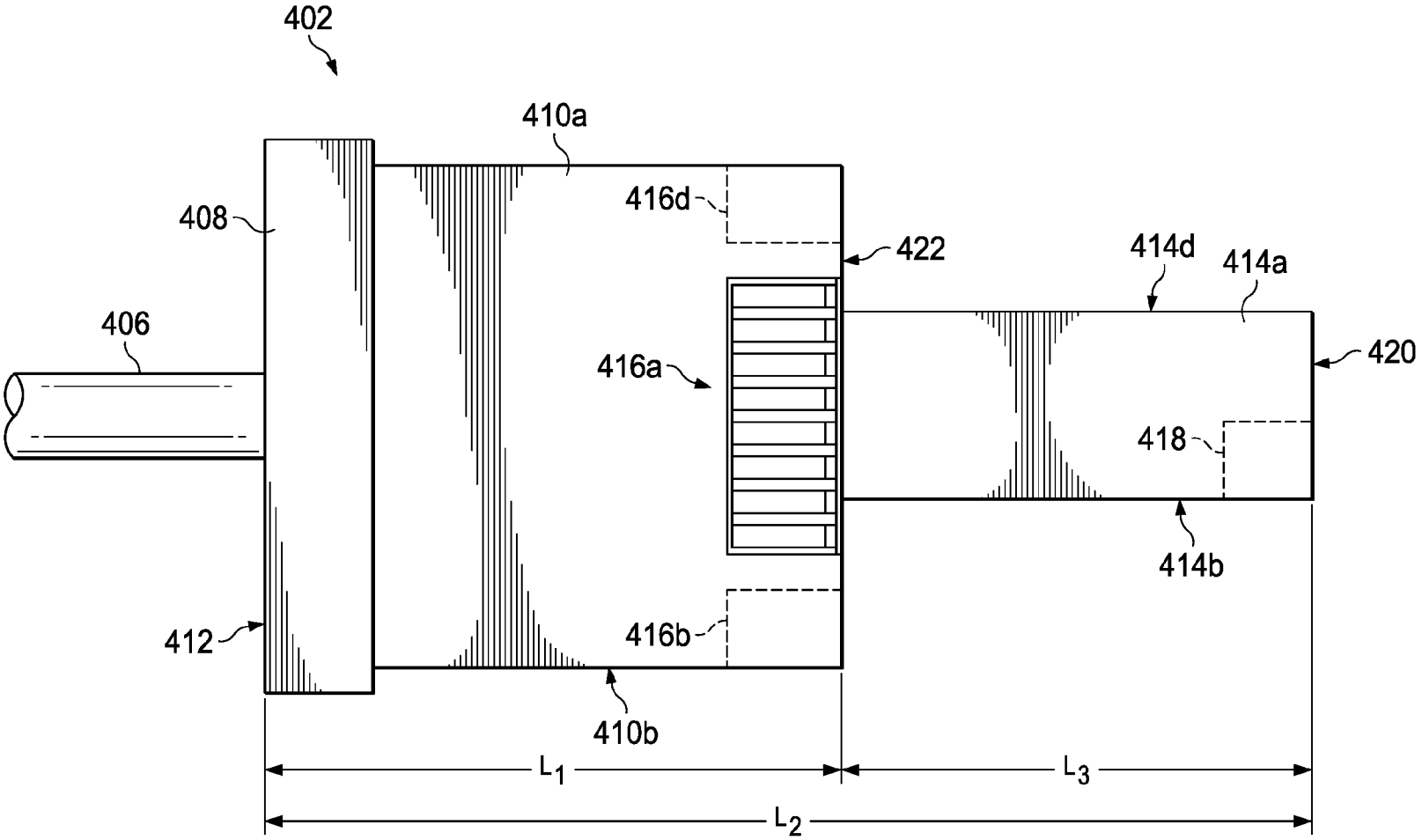
Figure 4C:
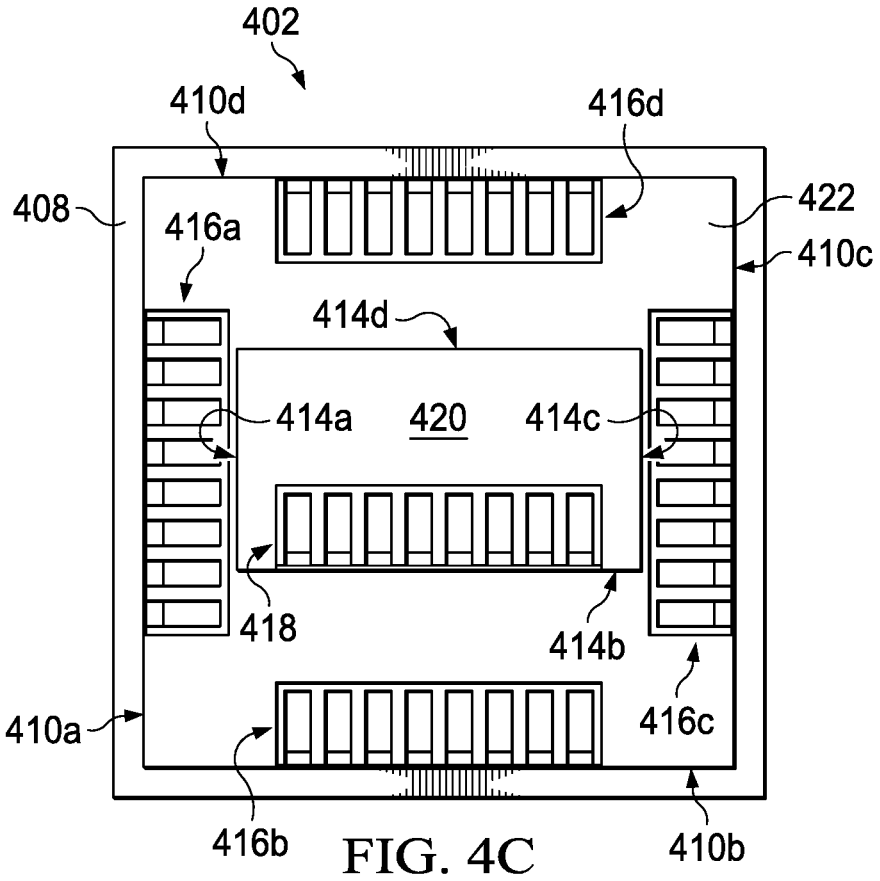
Figure 4D:
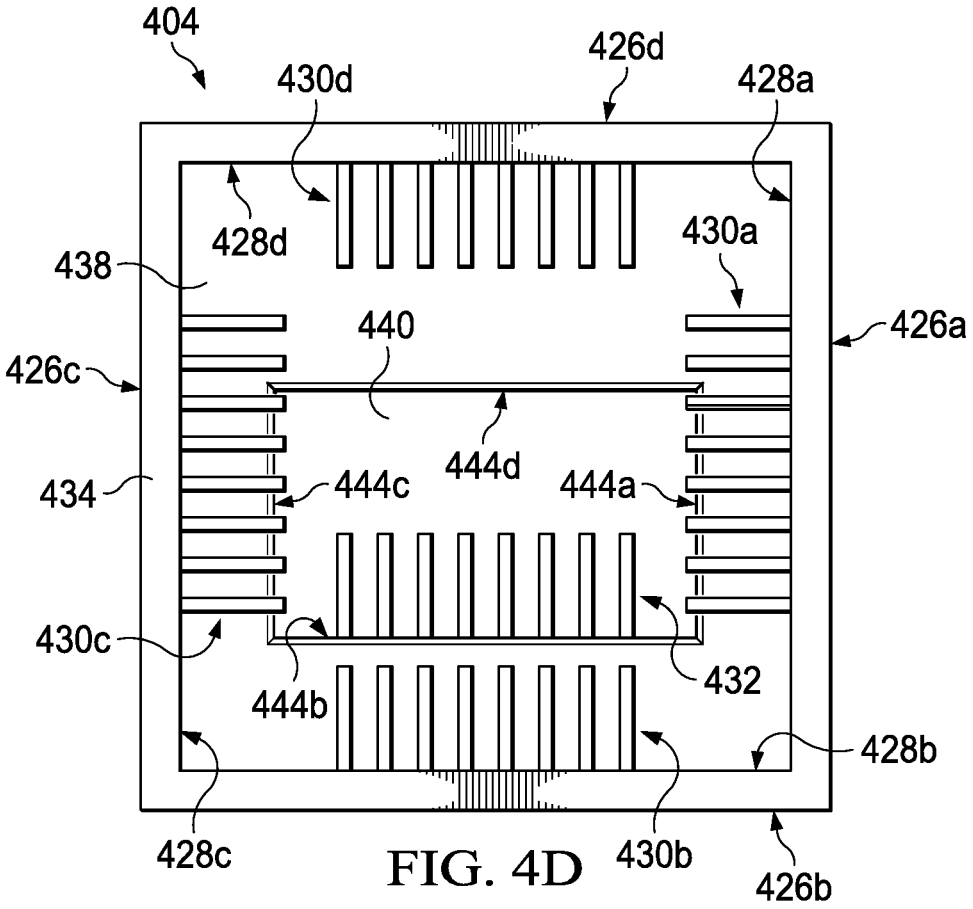
Figure 4E:
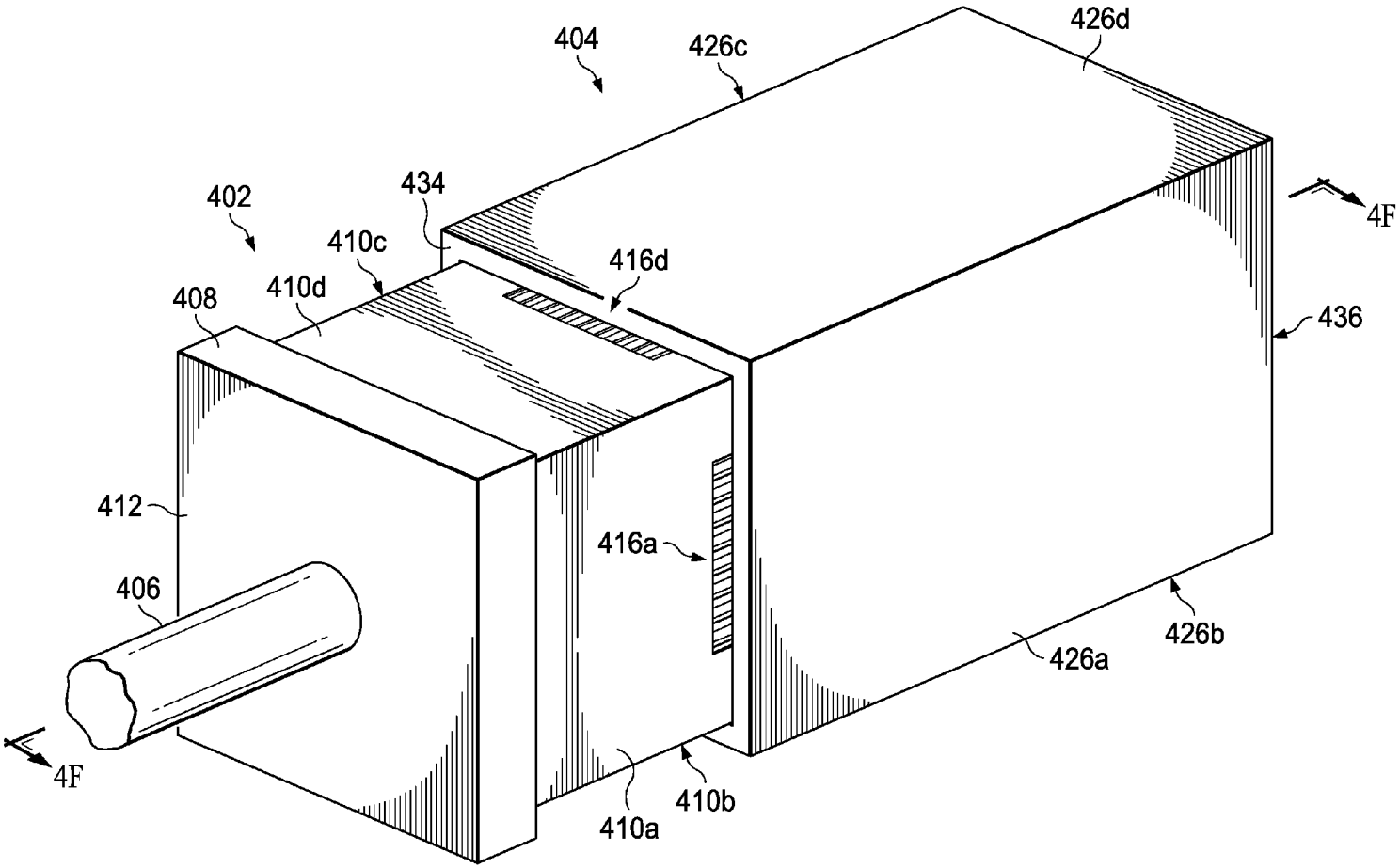
Figure 4F:
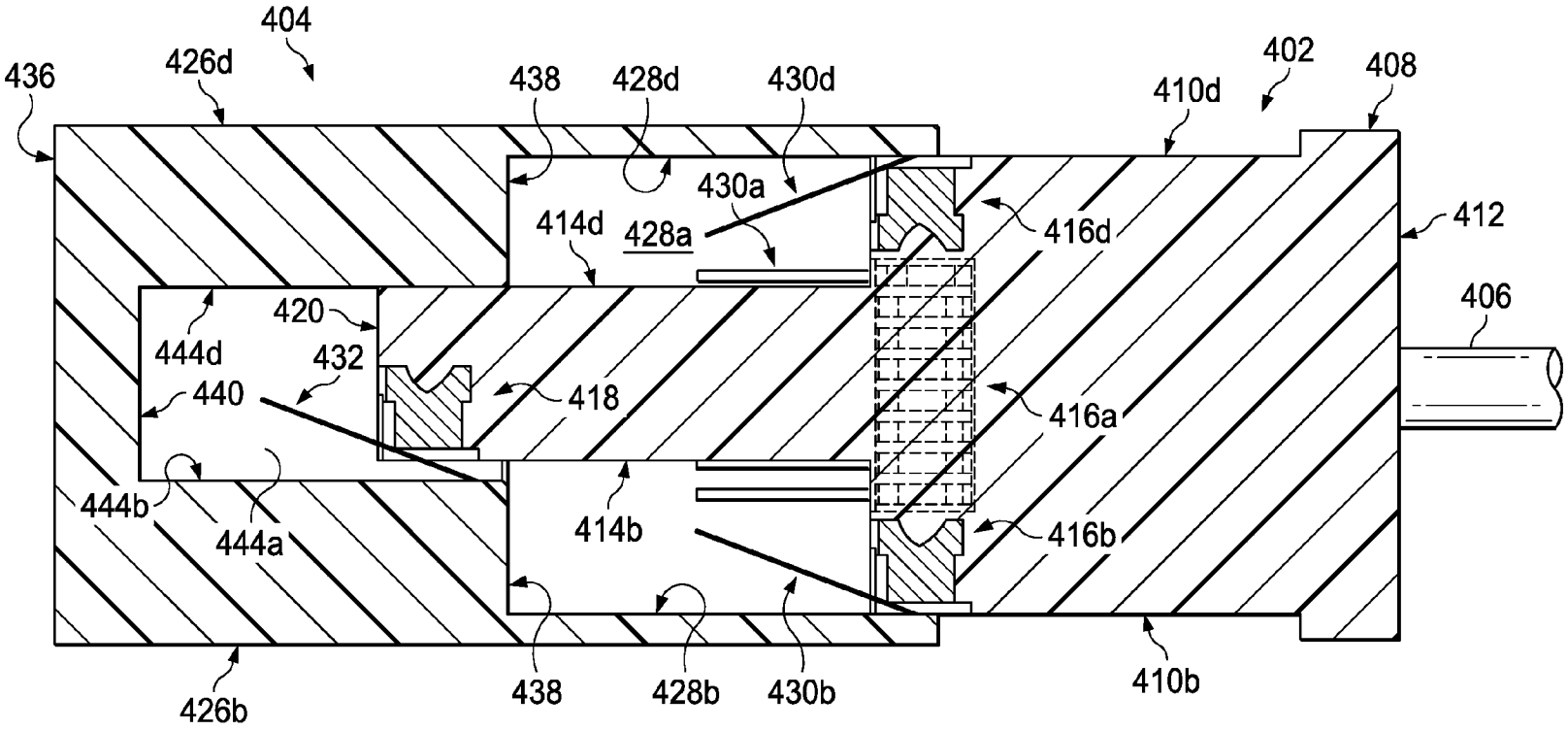

FIGS. 4A-1, 4A-2, 4B, 4C, 4D, 4E, and 4F are simplified diagrams of a high density connection system 400, according to some embodiments of the present disclosure. In this example, the high density connection system is based, at least in part, on a standardized 8P8C connector system and includes a plug and a receptacle. FIG. 4A-1 is a three-dimensional isometric view of a high density plug 402. FIG. 4A-2 is a three-dimensional isometric view of a high density receptacle 404, which corresponds to the high density plug 402. FIG. 4B is a side view of the high density plug 402. Arrows in FIG. 4A-1 labeled '4B' illustrate the viewpoint of FIG. 4B. FIG. 4C is a front view of the high density plug 402. Arrows in FIG. 4A-1 labeled '4C' illustrate the viewpoint of FIG. 4C. FIG. 4D is a front view of the high density receptacle 404. Arrows in FIG. 4A-2 labeled '4D' illustrate the viewpoint of FIG. 4D. FIG. 4E is a three-dimensional isometric view of the high density plug 402 and the high density receptacle 404 partially engaged with one another. FIG. 4F is a cross-sectional view of the high density plug 402 and the high density receptacle 404 partially engaged with one another. Arrows in FIG. 4E labeled '4F' illustrate the section lines and viewpoint of FIG. 4F.

Advantageously, each of the connectors in the connection system 400 includes a high density of electrical contacts or a high density of pins relative to a standard connector of a corresponding type. The high density plug 402 includes multiple sets of contacts (i.e., five sets of contacts), each in a standard 8P8C layout (e.g., with respect to dimensions and relative spacing), which increases the number of contacts relative to a standard plug. Consequently, the high density plug 402 can carry a throughput that is five times that of a standard plug. Moreover, the density of contacts (e.g., number of contacts per area consumed) is increased relative to a standard plug (as is discussed further below with respect to FIG. 5). The high density receptacle 404 includes multiple sets of pins (i.e., five sets of pins), each in a layout corresponding to a standard 8P8C plug (e.g., with respect to dimensions and relative spacing), which increases the density of pins relative to a standard receptacle. Moreover, the density of pins (e.g., number of pins per area consumed) is increased relative to a standard receptacle (as is discussed further below with respect to FIG. 5). Each set of pins or contacts is placed on a different surface of the high density connectors to make efficient use of the surfaces. In addition, at least two of the sets of contacts/pins are located at different positions measured along a length of the housing to make efficient use of the length of the housing.

Such high-density plugs and/or receptacles can carry the equivalent throughput (e.g., data, power, and/or light) of multiple standard plugs and/or receptacles while slightly increasing the area consumed on a device to which it connects. When employed on a large scale (e.g., in many devices in a data center), high density plugs and/or receptacles (as disclosed herein) can reduce costs associated with delivering services (e.g., by reducing the number of devices needed to deliver a certain throughput, by reducing the size of devices needed, reducing the overall size of the data center).

Turning now to the high density plug 402, simultaneous reference is made to reference numerals in each of FIGS. 4A-1, 4B, and 4C. The plug 402 has a high density of electrical contacts. The plug includes a plurality of sets of electrical contacts (i.e., sets of contacts 416*a*, 416*b*, 416*c*, 416*d*, and 418), a housing comprising a plurality of housing portions and a stopper 408, and a cable 406. Each of the housing portions is coupled to an adjacent housing portion. The stopper 408 projects from the sides, top, and bottom exterior surfaces of the plug 402 (i.e., extends around an entire perimeter of the plug). The dimensions and relative spacing of each set of electrical contacts corresponds to a standard 8P8C plug. For example, spacing between electrical contacts in each of the plurality of sets of contacts match spacing between electrical contacts of a standard 8P8C modular plug. Thus, each of the plurality of sets of electrical contacts (i.e., sets of contacts 416*a*, 416*b*, 416*c*, 416*d*, and 418) are identical to one another (e.g., in size and shape). Similar contacts are described with respect to FIGS. 3A-1 and are not repeated here only for brevity.

It is noted that each of the sets of contacts need not be identical to one another. For example, a foremost set of contacts (e.g., set 418) may be an 8P8C contacts layout while each of the other sets of contacts (e.g., sets 416*a-d*) may be a 4P4C contact layout. Thus, the sets of contacts within each layer are identical to one another while each layer may have different contact layouts with respect to other layers. In still further examples, the sets of contacts on a single layer may implement different contact layouts. For example, a single layer may include one or more 8P8C contact layouts (e.g., sets 416*a* and 416*c*) and one or more 4P4C layouts (e.g., sets 416*b* and 416*d*).

In the example of FIGS. 4A-1, 4B, and 4C, the cable 406 comprises a plurality of wires. Each contact (in each of the plurality of sets of contacts) is electrically coupled to one of the plurality of wires in the cable. A coupling mechanism couples each contact to the corresponding wire. A coupling mechanism is inclusive of a solder, a sharpened prong to facilitate crimping the plug to a cable (e.g., by connecting each contact to a wire), or any other mechanism operable to make an electrical connection between a contact and a wire. In some examples, each contact is connected to a different wire (e.g., the number of wires in the cable is equal to the number of contacts). In other examples, two or more contacts are connected to a single wire (e.g., the number of wires in the cable is less than the number of contacts). Because the high density plug 402 includes five sets of contacts (each in a standard 8P8C layout), the cable 406 includes more wires than a standard cable (i.e., to provide pathways for signals to reach each contact). In effect, the cable 406 is a cable comprising the equivalent of five standard cables. Consequently, the cable can carry five times the throughput of a standard cable. In implementations where each contact is connected to a different wire, the cable 406 includes a number of wires that is equal to the number of contacts (i.e., 40 contacts and 40 wires). In implementations where two or more contacts are connected to a same wire, the cable 406 includes a number of wires that is less than the number of contacts (i.e., 40 contacts and fewer than 40 wires). The high density plug 402 occupies one end of the cable 406. An opposite end of the cable (not shown) may include multiple standard plugs and/or another high density plug. For example, the opposite of the cable may be broken out into multiple individual wiring sets that each connect to a standard 8P8C plug (e.g., five plugs, each like that illustrated in FIG. 3A-1). In further implementations, the opposite of the cable may include another instance of the high density plug 402. In some specific implementations, the cable 406 is a twisted-pair cable (e.g., an Ethernet cable transmitting data and/or power) and includes the wiring equivalent of five standard twisted-pair cables.

In the example of FIGS. 4A-1, 4B, and 4C, the plug 402 includes a housing comprising two stepped housing portions. Each of the surfaces 410*a-d* and 422 (i.e., top surface 410*d*, side surfaces 410*a* and 410*c*, bottom surface 410*b*, front end surface 422), at least in part, define a first housing portion (e.g., a first step). The surfaces 414*a-d* and 420 (i.e., top surface 414*d*, side surfaces 414*a* and 414*c*, and bottom surface 414*b*, and front end surface 420), at least in part, define a second housing portion (e.g., a second step). The surfaces 422 and 420 are substantially parallel to one another. The housing further includes a rear surface 412 located at an opposite extreme end of the housing relative to the front surface 420. Each of the surfaces is planar and approximately perpendicular to adjacent surfaces. Consequently, the housing has right angles at its edges. The first housing portion is coupled to the second housing portion. The second housing portion protrudes from the first housing portion and is a foremost portion of the plug.

FIGS. 4A-1 and 4B show, among other things, the housing of the plug 402 progressively narrowing (i.e., in a direction from the first housing portion toward the second housing portion). Thus, the housing of the plug 402 progressively broadens (in a direction from the second housing portion toward the first housing portion). Thus, each housing portion (or step) is smaller than an adjacent housing portion (with the exception of the foremost portion). The side surfaces of the second housing portion are recessed relative to corresponding side surfaces of the first housing portion.

Each of the plurality of housing portions supports one or more of the sets of electrical contacts proximate to a corresponding end. As is clear in FIG. 4A-1, the number of contacts at each step changes relative to adjacent steps. The number of sets supported by each of the housing portions decreases relative to the number of sets supported by an adjacent one of the portions. In the example of plug 402, the first housing portion supports four sets of contacts (i.e., sets of contacts 416*a-d*, a plurality of sets of contacts, a first layer of sets of contacts) and the second housing portion supports one set of contacts (i.e., set 418, a single additional set, a second layer of sets of contacts). Thus, the first housing portion supports a larger number of sets of contacts than the second housing portion.

The dimension and relative spacing of each set of electrical contacts (i.e., sets 416*a*, 416*b*, 416*c*, 416*d*, and 418) correspond to that of a standard 8P8C plug. While each of the sets 416*a-d* has a contact layout that implements a standard, the first housing portion (which supports the sets of contacts 416*a-d*) does not implement a standard and is newly introduced in the present specification. Indeed each of the sets of contacts 416*a-d* is at a different position around the first housing portion. In this example, each of the sets of contacts 416*a-d* is at an angular position relative to an adjacent one of sets (e.g., measured about a longitudinal axis of the housing and/or a center point of the end surface 420 of the second housing portion). FIG. 4F shows, among other things, each of the sets of contacts 416*a-d* being orientated at a 90-degree angle relative to an adjacent one of the sets of contacts 416*a-d*. The first housing portion (the foremost) is at least a portion of a standard 8P8C modular plug. The first housing portion does not include all features of the standard plug (e.g., no latch and no stopper) and is a truncated version of the standard plug. However, the foremost housing portion is operable to be partially inserted into a standard 8P8C receptacle (though the second portion would not fit into the standard 8P8C receptacle).

At least two sets of the electrical contacts are located at different positions measured along a length of the first housing (e.g., creating different layers of sets of contacts). Turning to FIGS. 4A-1 and 4B, each of sets of contacts 416*a-d* is supported adjacent the end 422 at a first distance (labeled 'L1') from a rear surface 412 and the set of contacts 418 is supported adjacent the end 420 at a second distance (labeled 'L2') from the rear surface 412. The second distance is larger than the first distance. In addition, the second housing portion protrudes from the first housing portion by a third distance (labeled 'L3'). The third distance is equal to a difference between the first distance and the second distance (i.e., L3=L2-L1). In effect, the third distance is the distance by which layers of contacts are offset from one another. This third distance substantially matches the distance by which layers of pins are offset from one another on the corresponding receptacle (i.e., receptacle 404 as described below with respect to FIGS. 4A-2 and 4D).

Turning now to the high density receptacle 404, simultaneous reference is made to reference numerals in each of FIGS. 4A-2 and 4D. The receptacle has a high density of pins. The receptacle 404 includes a plurality of sets of pins (i.e., sets of pins 430*a*, 430*b*, 430*c*, 430*d*, and 432) and a housing comprising a first set of walls and a second set of walls defining an elongated cavity. The first set of walls includes surfaces defining a first portion of the elongated cavity. The second set of walls includes surfaces defining a second portion of the elongated cavity. The dimensions and relative spacing of each set of pins corresponds to a standard 8P8C receptacle. For example, spacing between pins in each of the plurality of sets match spacing between pins of a standard 8P8C modular receptacle. Thus, each of the plurality of sets of pins (i.e., sets of pins 430*a*, 430*b*, 430*c*, 430*d*, and 432) is identical to the other sets of pins (e.g., in size and shape). Similar pins are described with respect to FIGS. 3A-2 and are not repeated here only for brevity.

It is noted that each of the sets of pins need not be identical to one another. For example, a foremost set of pins (e.g., set of pins 432) may be an 8P8C pin layout while each of the other sets of pins (i.e., sets of pins 430*a*, 430*b*, 430*c*, and 430*d*) may be 4P4C layout. Thus, the sets of pins within each layer are identical to one another while each layer may have different pin layouts with respect to other layers. In still further examples, the sets of pins on a single layer may implement different pin layouts. For example, a single layer may include one or more 8P8C pin layouts (e.g., sets 430*a* and 430*c*) and one or more 4P4C pin layouts (e.g., sets of pins 430*b* and 430*d*).

In the example of FIGS. 4A-2 and 4D, each of the pins 430*a-d* and 432 is connected to a wire (not shown) and/or a lead (not shown). For example, a cable (e.g., including wires bound together to form a single cable) may extend from the rear wall of the housing. The cable may be similar to cable 406 of FIG. 4A-2. In other implementations, a set of leads (e.g., for coupling the receptacle to a circuit board) may from the rear wall of the housing. Each pin (in each of the plurality of sets of pin) is electrically coupled to one of the plurality of wires in the cable or to one of the leads. A coupling mechanism couples each pin to a corresponding wire. A coupling mechanism is inclusive of a solder, a sharpened prong to facilitate crimping the receptacle to a cable (by connecting each pin to a wire), or any other mechanism operable to make an electrical connection between a pin and a wire and/or a lead. In some examples, each pin is connected to a different wire or lead (e.g., the number of wires in the cable is equal to the number of pins, or the number of leads is equal to the number of pins). In other examples, two or more pins are connected to a single wire or lead (e.g., the number of wires in the cable is less than the number of pins, or the number of leads is less than the number of pins). Because the high density receptacle includes five sets of pins (e.g., each in a standard 8P8C layout), a coupled cable (or set of leads) includes more wires (or more leads) than a standard cable (or a set of leads on a standard receptacle). In implementations where each pin is connected to a different wire (or lead), such a cable (or set of leads) includes a number of wires (or number of leads) in that is equal to the number of pins (i.e., 40 contacts and 40 wires, or 40 contacts and 40 leads). In implementations where two or more pins are connected to a same wire (or a same lead), such a cable (or set of leads) includes a number of wires (or number of leads) that is less than the number of pins (i.e., 40 contacts and fewer than 40 wires, or 40 contacts and fewer than 40 pins).

In some implementations, the high density receptacle 404 occupies one end of a cable. An opposite end of the cable may include multiple standard receptacles, another high density receptacle, multiple standard plugs, and/or a high density plug. For example, the opposite of the cable may be broken out into multiple individual wiring sets that each connect to a standard 8P8C receptacle (e.g., five receptacles, each like that illustrated in FIG. 3A-2). In further implementations, the opposite of the cable may include another instance of the high density receptacle 404. In other implementations, the high density receptacle 404 is coupled to a circuit board by a set of leads.

In the example of FIGS. 4A-2 and 4D, the receptacle 404 includes a housing that defines an elongated cavity having a stepped shape (e.g., a stepped socket). The interior surfaces 428*a-d*, 438, 432 (i.e., top surface 428*d*, side surfaces 428*a* and 428*c*, bottom surface 428*b*, rear surface 438, and front end surface 432), at least in part, correspond to a first set of walls that define a first portion of the elongated cavity (e.g., a first step of the stepped socket). The interior surfaces 444*a-d* and 440 (i.e., top surface 444*d*, side surfaces 444*a* and 444*c*, and bottom surface 444*d*, and rear surface 440), at least in part, correspond to a second set of walls that define a second portion of the elongated cavity (e.g., a second step of the stepped socket). The housing further includes exterior surfaces 426*a-d* and 436 (i.e., top surface 426*d*, side surfaces 426*a* and 426*c*, bottom surface 426*b*, and rear end surface 436). Each of the surfaces is planar and approximately perpendicular to adjacent surfaces. Consequently, the housing has right angles at its edges. The first set of wall is coupled to the second set of walls.

FIGS. 4A-2 and 4D show, among other things, the housing of the receptacle 404 progressively narrowing (i.e., in a direction from the front end 434 toward the rear end surface 436, and/or in a direction from the first set of walls toward the second set of walls). Thus, the housing of the receptacle 404 progressively broadens (i.e., in a direction from the rear end surface 436 toward the front end 434, and/or in a direction from the second set of walls toward the first housing set of walls). Thus, each portion of the elongated cavity (or step) is smaller than an adjacent housing portion (with the exception of the foremost portion). The interior surfaces of the second portion of the elongated cavity are recessed relative to corresponding interior surfaces of the first portion of the elongated cavity.

Each of the sets of walls supports one or more of the sets of pins. As is shown in FIG. 4A-2, the number of pins supported at each set of walls (i.e., at each step) changes relative to adjacent set of walls (i.e., the number of pins supported at each step changes relative to adjacent steps). The number of sets of pins supported at each set of walls decreases relative to the number of sets of pins supported by an adjacent one of the set of walls. In the example of receptacle 404, the first set of walls supports four sets of pins (i.e., sets v430*a-d*, a plurality of sets of pins, a first layer of sets of pins) and the second set of walls supports one set of pins (i.e., set 432, a single additional set of pins, a second layer of sets of pins). Thus, the first set of walls supports a larger number of sets of pins than the second set of walls.

The dimension and relative spacing of each set of pins (i.e., sets of pins 430*a*, 430*b*, 430*c*, 430*d*, and 432) corresponds to a standard 8P8C receptacle. While each of the sets of pins 430*a-d* has a pin layout that is standard, the first set of walls (i.e., which supports the sets of pins 430*a-d*) does not follow a standard and is newly introduced in the present specification. Indeed each of the sets of pins 430*a-d* is at a different position around the first portion of the elongated cavity. In this example, each of the sets of pins 430*a-d* is at an angular position relative to an adjacent one of the sets of pins (e.g., measured about a longitudinal axis of the housing and/or a center point of the end surface 434 of the housing). FIG. 4D shows, among other things, each of the sets of pins 430*a-d* being orientated at a 90-degree angle relative to an adjacent one of the sets of pins 430*a-d*. The second portion of the elongated cavity (the foremost portion) is at least a portion of a standard 8P8C modular receptacle. The second portion of the elongated cavity does not include all features of the standard receptacle (e.g., no depression for a latch) and is a truncated version of the standard receptacle. Advantageously, the foremost portion of the elongated cavity having a general size and shape corresponding to a standard 8P8C modular receptacle facilitates the foremost portion being operable to receive insertion of a standard 8P8C plug (i.e., as discussed below with respect to FIGS. 6C and 6D). Thus, a single high density plug can be selectively coupled to a high density plug (e.g., high density plug 402) and/or a standard plug (e.g., a plug similar to plug 302 of FIG. 3A-1 without the latch).

At least two sets of the pins are located at different depths measured along a length of the elongated cavity (i.e., creating different layers of sets of pins). FIGS. 4A-2 shows, among other things, that each of sets of pins 430*a-d* is supported by the first set of walls at a first depth (labeled 'L5') from the front surface 434 and the set of pins 432 is supported by the second set of walls at a second depth (labeled 'L4') from the front surface 434 of the housing. The second depth is larger than the first depth. Thus, the set of pins 432 is more deeply recessed into the elongated cavity than the sets of pins 430*a-d*. A third depth (labeled 'L6') is equal to a difference between the first depth and the second depth (i.e., L6=L4-L5). In effect, the third depth is the distance by which the layers of pins are offset from one another. This third depth substantially matches the distance by which the layers of contacts are offset from one another on the corresponding receptacle (e.g., distance L3 as described above with respect to FIGS. 4A-1 and 4B).

Turning to FIGS. 4E and 4F, FIG. 4E is a three-dimensional isometric view of the high density plug 402 and the high density receptacle 404 partially engaged with one another. FIG. 4F is a cross-sectional view of the high density plug 402 and the high density receptacle 404 partially engaged with one another. Arrows labeled '4F' in FIG. 4E illustrate the section lines and viewpoint of FIG. 4F. Because the locations of the contacts (i.e., sets of contacts 416*a*, 416*b*, 416*c*, 416*d*, and 418) on the plug 402 correspond to the locations of the pins (i.e., sets of pins 430*a*, 430*b*, 430*c*, 430*d*, and 432) on the receptacle 404, the contacts make physical contact with the pins when the plug 402 is inserted in the receptacle 404. Such physical contact establishes an electrically conductive connection between the contacts and the pins that is operable to transfer signals between the contacts and the pins. Advantageously, each of pins simultaneously contacts a corresponding one of the contacts based, at least in part, on the plug 402 being partially inserted into the receptacle 404. FIG. 4F shows, among other things, each of the following happening (substantially) simultaneously: each of the set of contacts 418 contacts a corresponding pin in the set of pins 432, each of the set of contacts 416*d* contacts a corresponding pin in the set of pins 430*d*, each of the set of contacts 416*b* contacts a corresponding pin in the set of pins 430*b*, each of the set of contacts 416*a* contacts a corresponding pin in the set of pins 430*a*, and each of the set of contacts 416*c* (not shown) contacts a corresponding pin in the set of pins 430*c* (not shown). Thus, insertion of a single high density plug into a corresponding high density receptacle simultaneously creates connections between a several sets of pins and contacts (at least two of which are located at different layers of the plug or receptacle). In FIGS. 4E and 4F, the plug 402 and the receptacle 404 are shown in a state when the contacts and the pins make initial contact with one another (when inserting). The insertion of plug 402 into receptacle 404 simultaneously creates connections between five sets of pins and five sets of contacts (or 40 pins and 40 contacts, in total). While the contacts (i.e., sets of contacts 416*a*, 416*b*, 416*c*, 416*d*, and 418) and the pins (i.e., sets 430*a*, 430*b*, 430*c*, 430*d*, and 432) remain in contact with one another, signals can be bi-directionally transferred between the contacts and the pins. In addition, each of pins simultaneously contacting the corresponding contacts creates an electrical pathway for bi-directional transmission of signals between the cable 406 and a second cable or a set of leads coupled to the receptacle (e.g., by way of the electrical contact between the pins and contacts).

The plug 402 can selectively engaged with (or disengaged from) a receptacle 404. When the plug 402 is advanced further into the elongated cavity in the receptacle 404 (i.e., relative to the state shown in FIGS. 4E and 4F), the contacts move (e.g., in a sliding motion) over the pins and remain in contact therewith. When advanced to the deepest depth allowable, the stopper 408 contacts the front surface of the receptacle 434. Likewise, when the plug 402 is further withdrawn from the elongated cavity in the receptacle 404 (i.e., relative to the state shown in FIGS. 4E and 4F), the contacts move (e.g., in a sliding motion) away from the pins and, thereby, break the physical contact between the contacts and pins.

Though the description of connectors in FIGS. 4A-1, 4A-2, 4B, 4C, 4D, 4E, and 4F (and other Figures of the present disclosure) references modular connectors such as 4P4C, 6P6C, 8P8C, and 10P10C, that is noted that the teachings of the present disclosure not limited to such modular connectors. The teachings of the present disclosure are equally applicable to other types of connectors. For examples, each of above identified modular connections includes an equal number of positions and contacts (e.g., each following the basic form of XPXC, where X is an integer greater than zero). However, the teachings of the present disclosure are equally applicable to N position, M contact modular connectors (e.g., where each of N and M is an integer greater than zero and N>M). In addition, the teachings of the present disclosure are equally applicable to improving optical fiber connectors (e.g., Mechanical Transfer Registered Jack (MT-RJ) as described in standards document IEC 61754-18, Lucent Connector (LC) as described in standards document IEC 61754-20), or any other connector where, according to the teachings herein, the contacts may be positioned at various positions about a housing of the connector.

Moreover, though the description of connectors in FIGS. 4A-1, 4A-2, 4B, 4C, 4D, 4E, and 4F (and other Figures of the present disclosure) illustrate high density connectors having two layers of contacts/pins and/or two steps within the housing, the teachings of the present disclosure not limited to modular connectors having only two layers and/or steps. In other implementations, a high density connector may comprise three, four, five, or any number of layers of contacts/pins (and corresponding steps within the housing).

Figure 5:
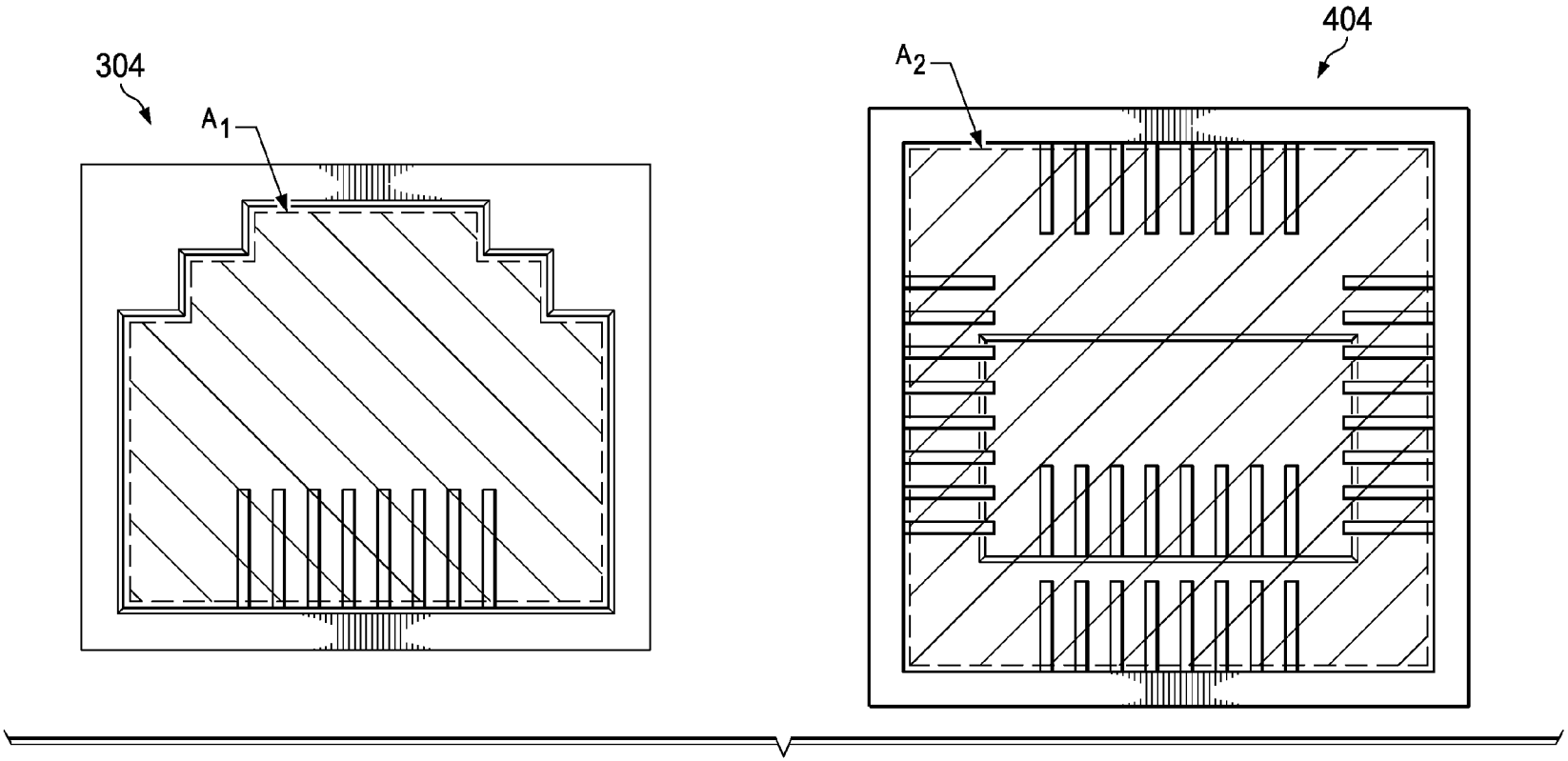
FIG. 5 illustrates a surface area of each of a standard receptacle and a high density receptacle according to some embodiments of the present disclosure.

Turning to FIG. 5, FIG. 5 illustrates a surface area of each of the standard receptacle 304 (of FIG. 3A-2) and the high density receptacle 404 (of FIG. 4A-2). The standard receptacle 304 has a surface area, A1. The high density receptacle 404 has a surface area, A2. The surface area A1 is less than the surface area A2. In particular, the surface area A2 is approximately 2.7 times the area of the surface area A1 (i.e., $A2 \approx 2.7 \times A1$). Because the high density receptacle 404 includes multiple sets of pins (i.e., five sets of pins), the density of pins (e.g., a number of pins per surface area) in the high density receptacle 404 is greater than the density of pins in the standard receptacle 304. As a further illustration of the difference in density of pins, it would take five of the standard receptacles 304 to match the number pins in the high density receptacle 404. However, the surface area of those five standard receptacles would be equal to five times the surface area A1, which is larger than the surface area A2 of 2.7 times the surface area of A1 (i.e., $5 \times A1 > 2.7 \times A1$). In other words, the high density receptacle 404 provides the equivalent number of contacts of five standard receptacles and only occupies the surface area of 2.7 standard receptacles, which represents a savings of 2.3 times the surface area of the standard receptacle 304. As another example, 50 of the standard receptacles 304 occupy a surface area of $50 \times A1$ and include 50 receptacle×8 pins/receptacle=400 pins, which results in a port density of $400/(50 \times A1)$ pins per unit area. Those 50 standard receptacles can be replaced by 10 high density receptacles 404, which occupy a surface area of $27 \times A1$, include 10 receptacles×40 pins/receptacle=400 pins, and results in a port density of $400/(27 \times A1)$ pins per unit area. Thus, the high density receptacles 404 can increase pin density by a factor of $[400/(27 \times A1)]/[400/(50 \times A1)]=[1/(27)]/[1/(50)]$ 1.85 relative to the standard receptacle 304. The high density receptacle 404 advantageously increases the density of pins relative to a standard receptacle. Such an increase in pin density is due, at least in part, to set of pins being placed on different surfaces and at different layers of the high density receptacle 404. The same increase in seen with respect to contact density on a high density plug relative to a standard plug; the description is not repeated here only for brevity.

Figure 6A:
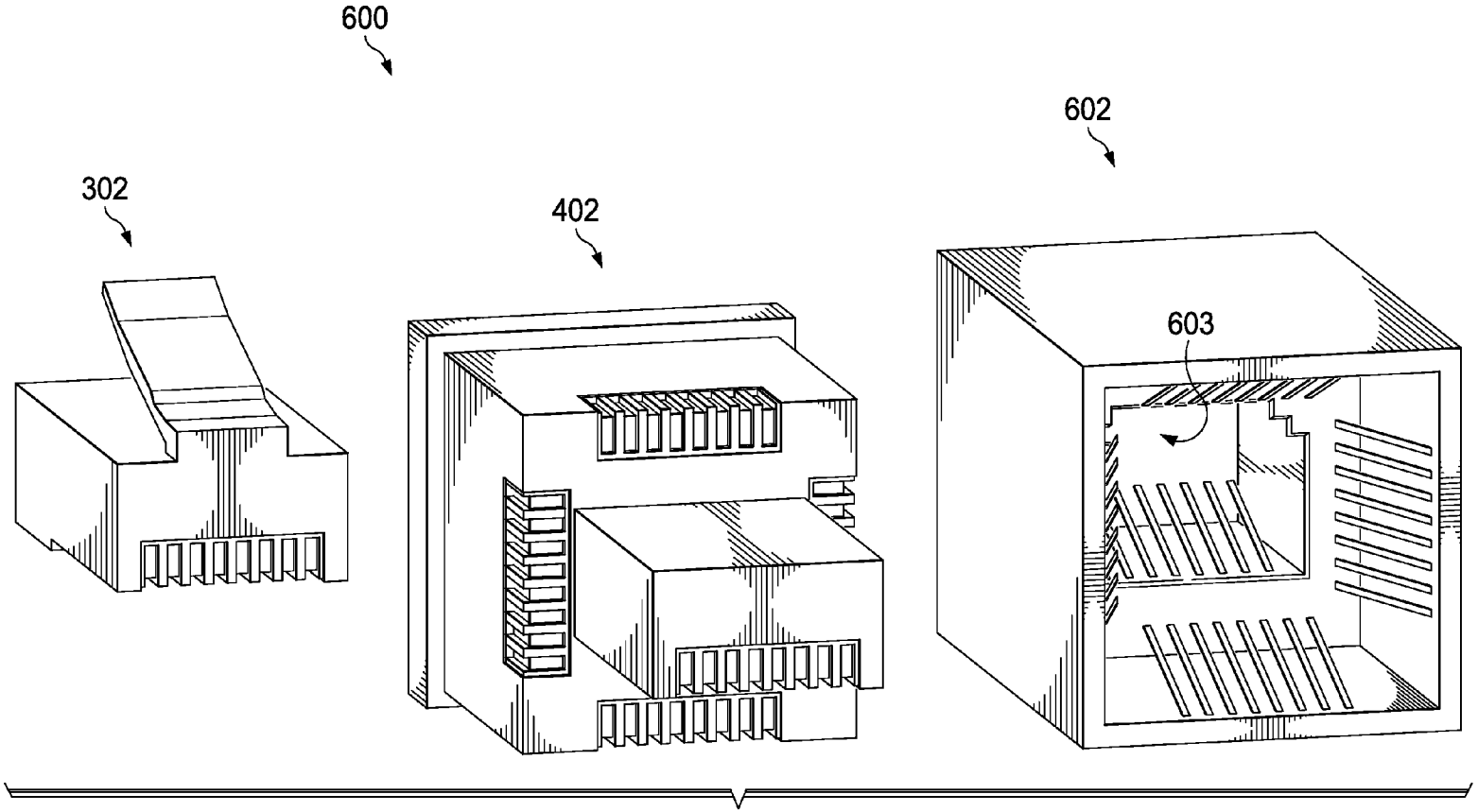
FIGS. 6A, 6B, 6C, and 6D are simplified diagrams of a modular connector system in which a high-density plug is operable to receive insertion of a standard plug and a high-density plug according to some embodiments of the present disclosure.
Figure 6B:
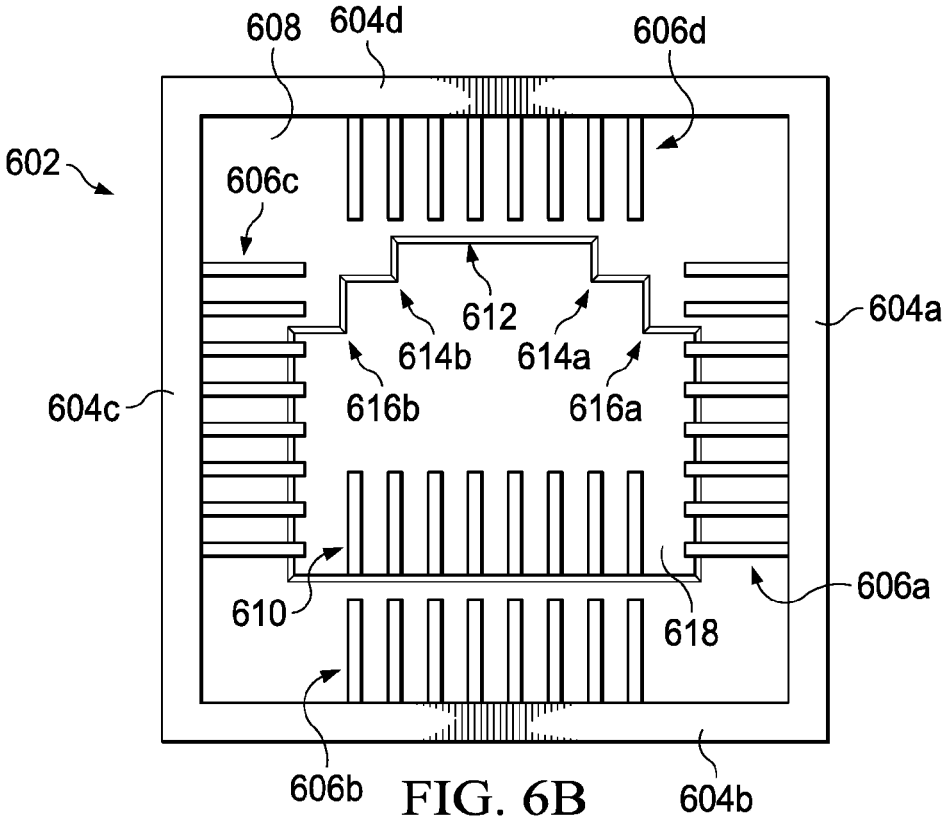
Figure 6C:
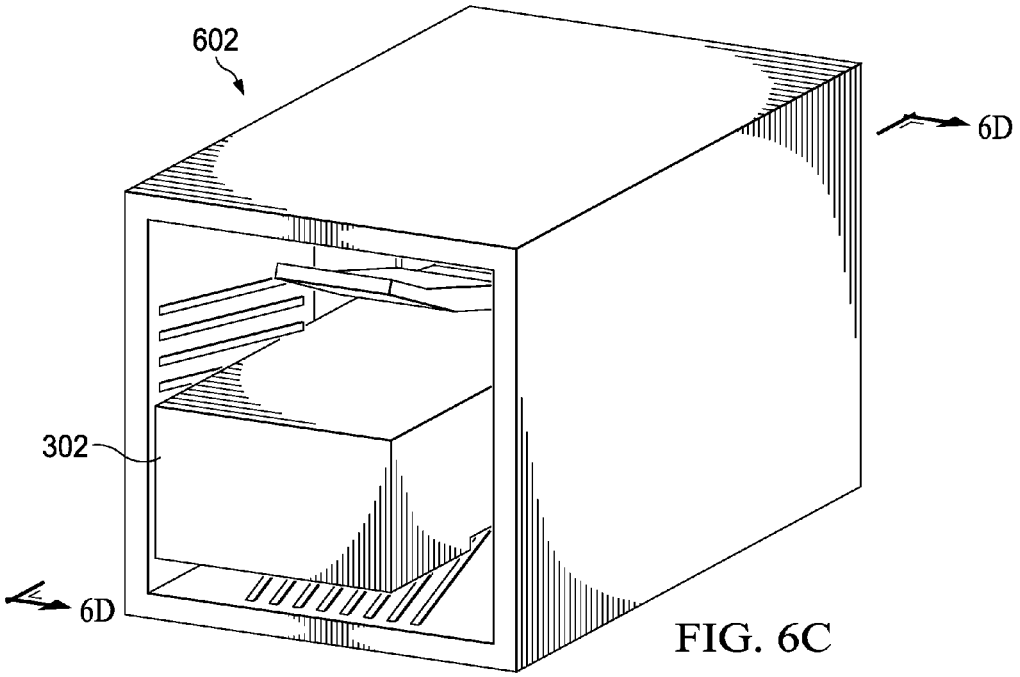
Figure 6D:
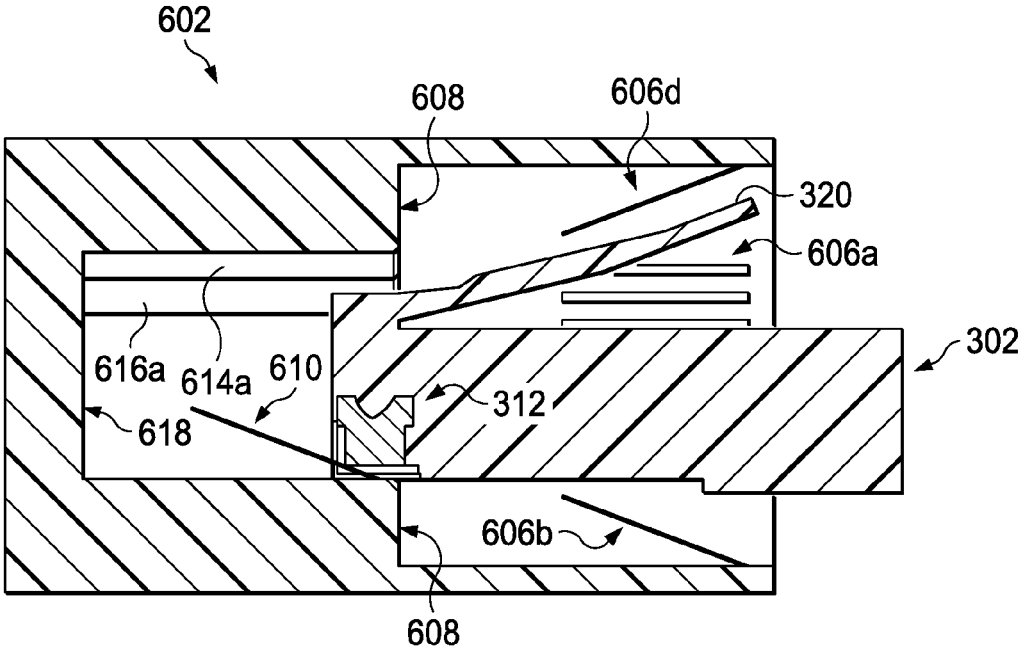

Turning to FIGS. 6A, 6B, 6C, and 6D, FIGS. 6A, 6B, 6C, and 6D are simplified diagrams of modular connector system 400 in which a high-density receptacle 602 is operable to receive insertion of a standard plug 302 and a high-density plug 402. FIG. 6A is a three-dimensional isometric view of the high-density receptacle 602, the standard plug 302, and the high-density plug 402. FIG. 6B is a front view of the high density receptacle 602. FIG. 6C is a three-dimensional isometric view of the standard plug 302 and the high density receptacle 602 partially engaged with one another. FIG. 6D is a cross-sectional view of FIG. 6C in which the standard plug 302 and the high density receptacle 602 partially engaged with one another. Arrows in FIG. 6C labeled '6D' illustrate the section lines and viewpoint of FIG. 6D.

Turning to FIG. 6A, the high-density receptacle 602 is substantially similar to the receptacle 404 of FIGS. 4A-2, 4D, 4E, and 4F. Thus, details described with respect to receptacle 404 are applicable to receptacle 602 and are not repeated here only for the purpose of brevity. One difference between the receptacles 602 and 404 is that the receptacle 602 includes a depression 603 in a foremost portion of the elongated cavity while the receptacle 404 lacks such a depression. The high-density plug 402 is described with respect to FIGS. 4A-1, 4B, 4C, 4E, and 4F; the description is not repeated here only for the purpose of brevity. The standard plug 302 is described with respect to FIGS. 3A-1 and 3B; the description is not repeated here only for the purpose of brevity. It is noted that each of plugs 302 and 402 and the receptacle 602 may comprise cables and/or leads. The cables and/or leads are omitted from the Figures only for simplicity of the Figures.

The high density receptacle 602 can be selectively coupled to the high density plug 402 and/or the standard plug 302. The high density plug 402 can be operably inserted into the high density receptacle 602, which simultaneously creates connections between pins in the receptacle and contacts in the plug (e.g., as described above with respect to FIGS. 4E and 4F). In addition, a foremost portion of the elongated cavity of the receptacle 602 has a general size and shape corresponding to a standard 8P8C modular receptacle, which advantageous facilitates the foremost portion being operable to receive insertion of a standard 8P8C plug (as discussed below with respect to FIGS. 6C and 6D).

Turning to FIG. 6B, the receptacle 602 includes walls 604*a-d*, 608, and 618, sets of pins 606*a-d* and 610, and a depression. The top surface 612 and stepped portions 614*a-b* and 616*a-b* define the depression. The depression, at least in part, provides the receptacle 602 compatibility with a standard plug that includes a latch. When the plug 302 is properly inserted into the receptacle 602, the set of contacts on the plug 302 make physical contact with only the set of pins 610 on the receptacle 602.

Turning to FIGS. 6C and 6D, FIGS. 6C and 6D shows, among other things, the standard plug 302 being properly inserted into the high density receptacle 602 (i.e., partially engaged). The plug 302 and the receptacle 602 are shown in a state in which the contacts (on the plug 302) and the pins (on the receptacle 602) make initial contact with one another. The insertion of plug 302 into receptacle 602 simultaneously creates connections between the set of pins 312 and the sets of contacts 610 (i.e., or 8 pins and 8 contacts, in total). The other pins 606*a-d* of the receptacle 602 are not engaged in this state. While the contacts 312 and the pins 610 remain in contact with one another, signals can be bi-directionally transferred between the contacts 312 and the pins 610. In addition, each of pins 610 simultaneously contacting the corresponding contacts creates an electrical pathway for bi-directional transmission of signals between the any cables or leads present on either (or both) of the plug 302 and receptacle 602.

The standard plug 302 can be selectively engaged with (or disengaged from) the high density receptacle 404. Turning to FIG. 6D, when the plug 302 is advanced further into the elongated cavity in the receptacle 602 (i.e., relative to the state shown in FIGS. 6E and 6D), the contacts 312 move (e.g., in a sliding motion) over the pins 610 and remain in contact therewith. Moreover, when the plug 302 is fully inserted into the receptacle, the latch 320 engages the stepped portions (e.g., 616*a-b* and/or 614*a-b*) to secure the location of the plug within the receptacle 602 and a front surface of the plug 302 contacts the rear surface 618 of the receptacle 602. When the plug 302 is further withdrawn from the elongated cavity in the receptacle 602 (i.e., relative to the state shown in FIGS. 6E and 6D), the contacts 312 move (e.g., in a sliding motion) away from the pins 610 and, thereby, break the physical contact between the contacts and pins.

Figure 7A:
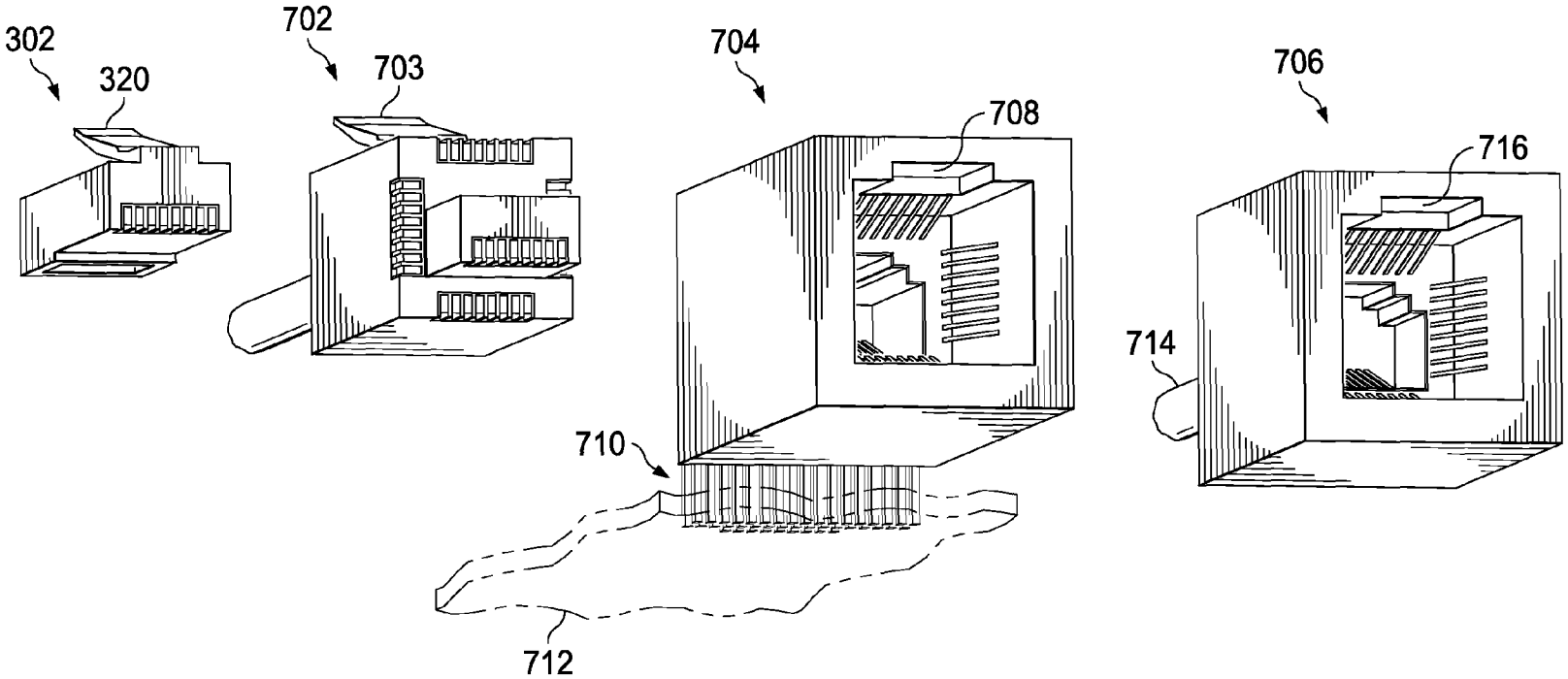
FIGS. 7A and 7B are simplified diagrams of a modular connector system in which various high-density receptacles are operable to receive insertion of a standard plug and a high-density plug according to some embodiments of the present disclosure.
Figure 7B:
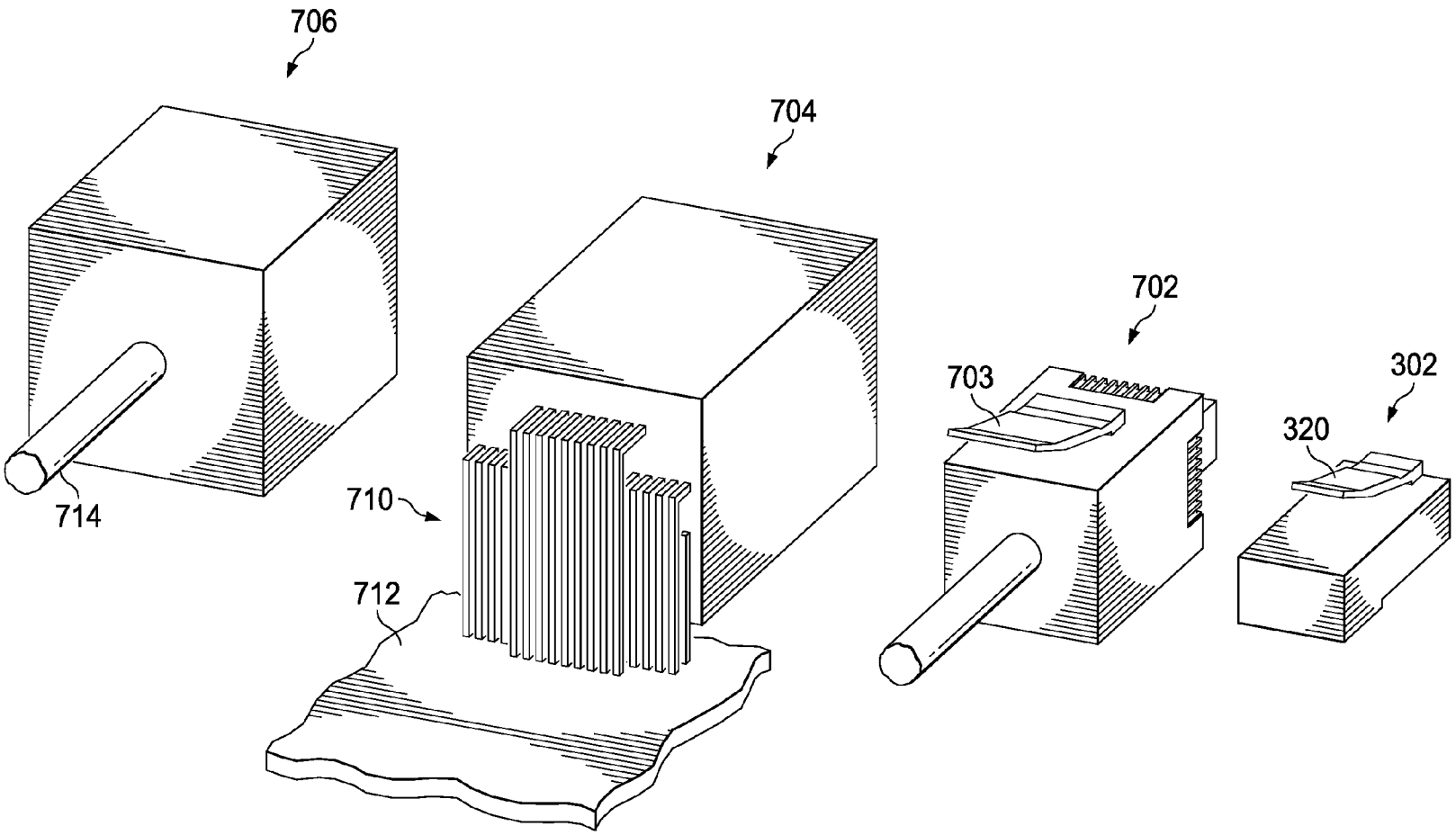

Turning to FIGS. 7A and 7B, FIGS. 7A and 7B are simplified diagrams of modular connector system in which each of high-density receptacles 704 and 706 is operable to receive insertion of the standard plug 302 and a high-density plug 702. FIG. 7A is a three-dimensional isometric view of the high-density receptacle 704, the high-density receptacle 706, the standard plug 302, and the high-density plug 702. FIG. 7B is another three-dimensional isometric view of the high-density receptacle 704, the high-density receptacle 706, the standard plug 302, and the high-density plug 702 of FIG. 7A.

In the following description, simultaneous reference is made to reference numerals in FIGS. 7A and 7B. The standard plug 302 is described with respect to FIGS. 3A-1 and 3B; the description is not repeated here only for the purpose of brevity. The high-density plug 702 of FIGS. 7A-B is substantially similar to the high-density plug 402 of FIGS. 4A-1, 4B, 4C, 4E, and 4F. Thus, details described with respect to high-density plug 402 are applicable to the high-density plug 702 and are not repeated here only for the purpose of brevity. One difference between the high-density plugs 702 and 402 is that the plug 702 includes a latch 703 while the plug 402 lacks such a latch. In this example, the latch 703 is larger than a standard latch (e.g., larger in width and thickness relative to the latch 320 of FIG. 3A-1). Each of the high-density receptacles 704 and 706 of FIGS. 7A and 7B is substantially similar to the high-density receptacle 602 of FIGS. 6A-D. Thus, details described with respect to high-density receptacle 602 are applicable to each of the high-density receptacles 704 and 706 and are not repeated here only for the purpose of brevity. One difference between each of the high-density receptacles 704 and 706 and the high-density receptacle 602 is that the receptacle 704 includes a set of leads 710 (i.e., electrically coupling the receptacle to a circuit board 712) and the receptacle 706 includes a cable 714 (i.e., electrically coupling the receptacle to a signal source) while the receptacle 602 lacks both the set of leads and the cable (only for simplicity of the FIGS. 6A-D). Another difference between each of the high-density receptacles 704 and 706 and the high-density receptacle 602 is that each of the receptacles 704 and 706 includes a depression (i.e., depressions 708 and 716 respectively) to accommodate the enlarged latch 703 of plug 702 while the receptacle 602 lacks such a depression.

Each of the plugs 302 and 702 can be operably coupled to (e.g., by insertion into and/or withdrawal from) each of the high density receptacles 704 and 706. Advantageously, any combination of plug and receptacle selected from those illustrated in FIGS. 7A and 7B can be connected by inserting the plug into at least a portion of the cavity in the receptacle. Because a foremost portion of the elongated cavity of each of the high density receptacles 704 and 706 is compatible with standard plugs, standard plugs and high density plugs are interchangeable with respect to coupling to those receptacles. For example, the high density receptacle 704 can be selectively coupled to the high density plug 702. In addition, the high density receptacle 704 can be selectively coupled to the standard plug 302. The high density plug 702 can be operably inserted into the high density receptacle 704, which simultaneously creates connections between pins in the receptacle 704 and contacts in the plug 702 (e.g., as described above with respect to FIGS. 4E and 4F and/or as described below with respect to FIGS. 8A-B and 9A-C). In addition, a foremost portion of the elongated cavity of the receptacle 704 has a general size and shape corresponding to a standard 8P8C modular receptacle, which advantageously facilitates the foremost portion being operable to receive insertion of a standard 8P8C plug 302 (e.g., as discussed above with respect to FIGS. 6C and 6D). Furthermore, the high density receptacle 706 can be selectively coupled to the high density plug 702. In addition, the high density receptacle 706 can be selectively coupled to the standard plug 302. For example, the high density plug 702 can be operably inserted into the high density receptacle 706, which simultaneously creates connections between pins in the receptacle 706 and contacts in the plug 702 (e.g., as described above with respect to FIGS. 4E and 4F and/or as described below with respect to FIGS. 8A-B and 9A-C). In addition, a foremost portion of the elongated cavity of the receptacle 706 has a general size and shape corresponding to a standard 8P8C modular receptacle, which advantageously facilitates the foremost portion being operable to receive insertion of the standard 8P8C plug 302 (e.g., as discussed above with respect to FIGS. 6C and 6D).

In some implementations of the system of FIGS. 7A and 7B, the circuit board 712 corresponds to either of the circuit boards 160 and 178 of FIG. 1C. In further implementations, the plug 704 is a component of an endpoint, network element, or other electronic device (e.g., coupled to circuit board 712 which is located within such an electronic device). In further implementations, the plug 706 is located in a wall socket coupling the plug to a service provider network (e.g., an Internet service provider (ISP) network, a light as a service (LaaS) network, a power over Ethernet (PoE) network).

Figure 8A:
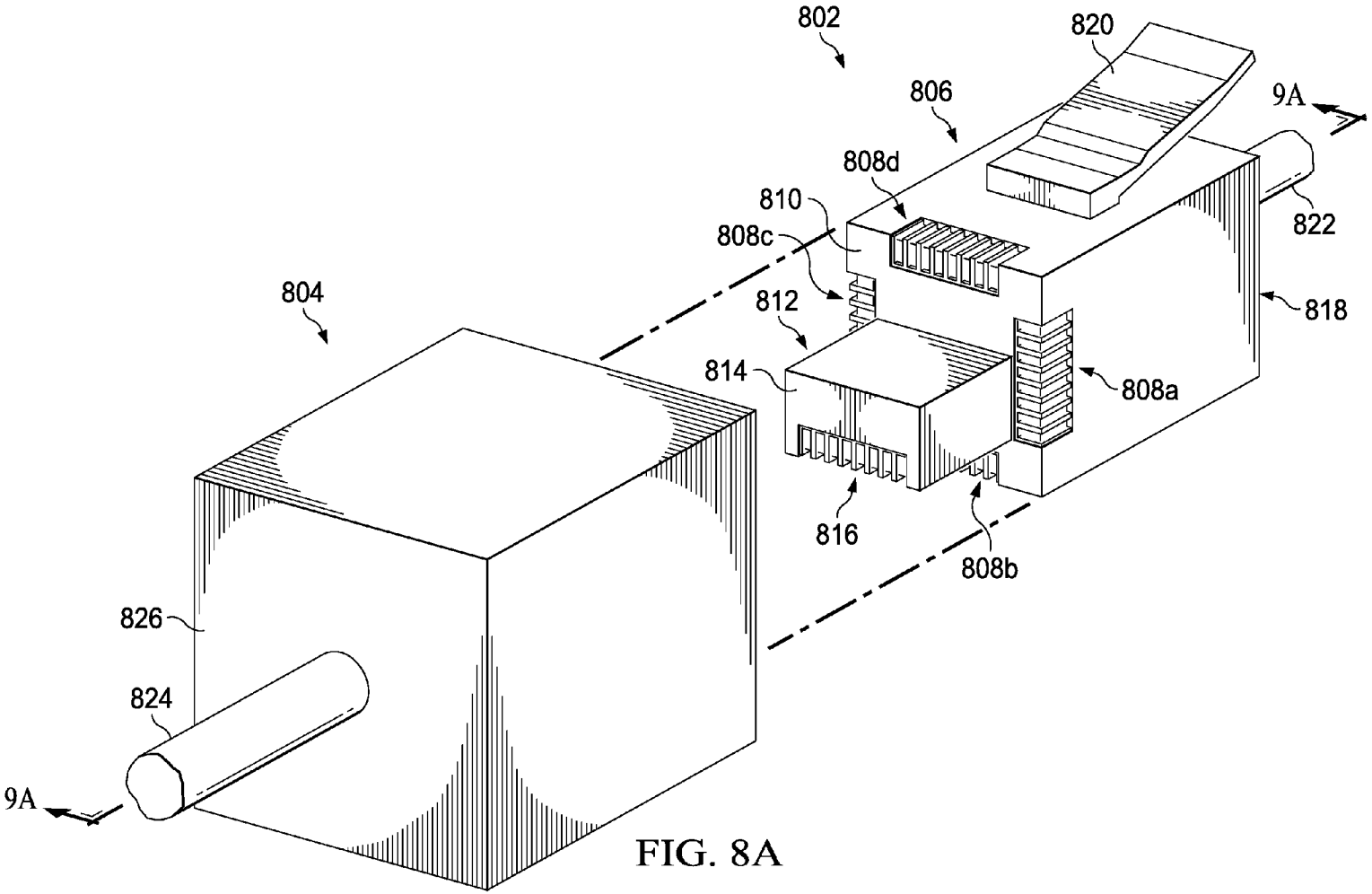
FIGS. 8A and 8B are simplified diagrams of a modular connector system including a high-density plug and a high-density receptacle according to some embodiments of the present disclosure.
Figure 8B:
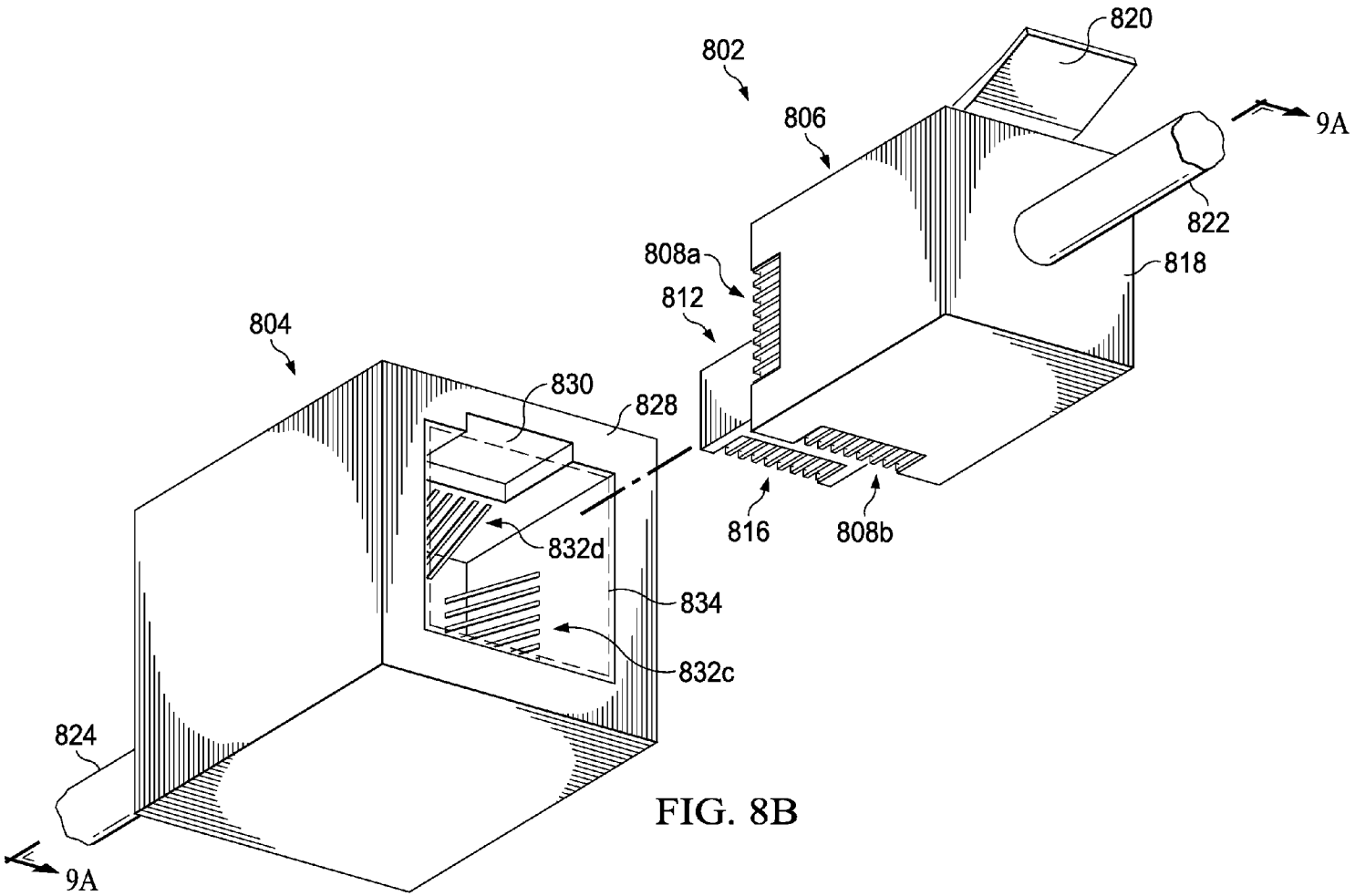
Figure 9A:
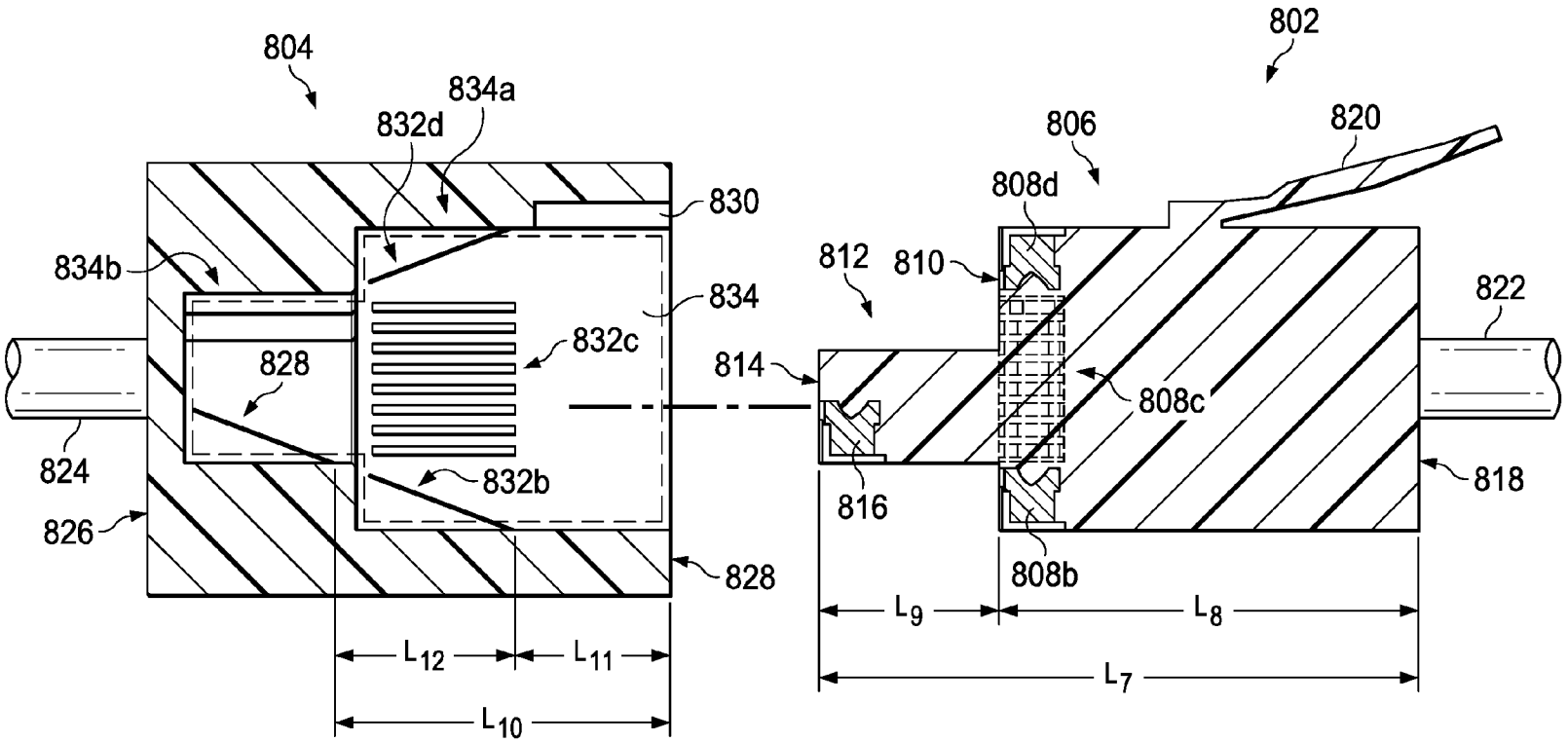
FIG. 9A is a cross-sectional view of the system of FIGS. 8A and 8B.

Turning to FIGS. 8A, 8B, and 9A, FIGS. 8A and 8B are simplified diagrams of a modular connector system including a high-density plug 802 and a high-density receptacle 804 and FIG. 9A is a cross-sectional view of the system of FIGS. 8A and 8B. FIG. 8A is a three-dimensional isometric view of the high-density plug 802 and the high-density receptacle 804. FIG. 8B is another three-dimensional isometric view of the high-density plug 802 and the high-density receptacle 804 of FIG. 8A. Arrows in FIGS. 8A and 8B labeled '9A' illustrate the section lines and viewpoint of FIG. 9A.

Turning now to the high density plug 802, simultaneous reference is made to reference numerals in each of FIGS. 8A, 8B, and 9A. The high density plug 802 is an example of the plug 703 of FIGS. 7A-B. The details described with respect to plug 703 are applicable to plug 802 and some of which are not repeated here only for the purpose of brevity. The high density plug 802 comprises a plurality of sets of electrical contacts (i.e., sets of contacts 808*a*, 808*b*, 808*c*, 808*d*, and 816), a latch 820, a cable 822, and a housing, which includes a plurality of housing portions (i.e., a first housing portion 806 and a second housing portion 812). Each of the plurality of housing portions comprises a corresponding planar end. The first housing portion 806 has a planar end 810. The second housing portion 812 has a planar end 814. In addition, each of the plurality of housing portions supports a number of the plurality of sets of electrical contacts proximate to the corresponding planar end. The first housing portion 806 supports four of the total five sets of contacts. In particular, the first housing portion 806 supports sets of contacts 808*a*, 808*b*, 808*c*, and 808*d* proximate the planar end 810. The second housing portion 812 supports one of the total five sets of contacts. In particular, the second housing portion 812 supports the set of contacts 816 proximate the planar end 814. At least two sets of the plurality of sets of electrical contacts are located at different positions measured along a length of the housing of the plug. The sets of contacts 808*a*, 808*b*, 808*c*, and 808*d* are located at a first length (labeled 'L8' in FIG. 9A) measured along the length of the housing of the plug 802 (i.e., measured relative to a fixed point on the housing such as an endpoint 818 of the plug). The set of contacts 816 is located at a second length (labeled 'L7' in FIG. 9A) measured along the length of the housing of the plug 802 (e.g., measured relative to the fixed point on the housing such as an endpoint of the plug). The first length L8 and the second length L7 are different positions measured along a length of the housing of the plug 802. The distance L7 is larger than the distance L8. In addition, the second housing portion protrudes from the first housing portion by a third distance (labeled 'L9' in FIG. 9A). The third distance is equal to a difference between the distance L7 and the distance L8 (i.e., L9=L7-L8). In effect, the distance L9 is the distance by which the layers of contacts are offset from one another. The distance L9 substantially matches the distance by which the layers of pins are offset from one another on the receptacle 804 (i.e., distance L12, as described further below). The cable 822 includes a plurality of wires. Each electrical contact in each of the plurality of sets of electrical contacts is electrically coupled to a corresponding one of the plurality of wires in the cable 822. In some examples, the cable 822 includes wiring equivalent to that of five standard cables (e.g., five twisted pair cables, five Ethernet cables, and the like) for coupling to the five sets of contacts of the plug 802. The latch 820 is larger than a standard latch (e.g., larger in width and thickness relative to the latch 320 of FIG. 3A-1). The enlarged size of the latch 820 is, at least in part, to support additional weight of the cable 822 relative to a standard cable. Each of the plurality of sets of electrical contacts is positioned about the housing portion at an angular position relative to an adjacent one of the plurality of sets of electrical contacts. In FIG. 9A a longitudinal axis of the housing is illustrated as a centerline located between the plug and receptacle. In some implementations, the angular positions (at which sets of contacts are positioned about the housing) are measured about the longitudinal axis.

The dimensions and relative spacing of each set of electrical contacts (sets of contacts 808*a-d* and 816) corresponding to a standard 8P8C plug. For example, spacing between electrical contacts in each of the plurality of sets match spacing between electrical contacts of a standard 8P8C modular plug. Thus, each of the plurality of sets of electrical contacts (i.e., sets of contacts 808*a*, 808*b*, 808*c*, 808*d*, and 816) are identical to one another (e.g., in size and shape). Similar contacts are described with respect to FIGS. 3A-1 and are not repeated here only for brevity.

It is noted that each of the sets of contacts need not be identical to one another. For example, a foremost set of contacts (e.g., set of contacts 816) may be a 6P6C contact layout while each of the other sets of contacts (e.g., sets of contacts 808*a-d*) may be an 8P8C contact layout. Thus, the sets of contacts within each layer are identical to one another while each layer may have different contact layouts with respect to other layers. In still further examples, the sets of contacts on a single layer may implement different contact layouts. For example, a single layer may include one or more 8P8C contact layouts (e.g., sets 808*a* and 808*c*) and one or more 6P6C contact layouts (e.g., sets 808*b* and 808*d*).

Turning now to the high density receptacle 804, simultaneous reference is made to reference numerals in each of FIGS. 8A, 8B, and 9A. The high density receptacle 804 is an example of either (or both) of the receptacles 704 and 706 of FIGS. 7A-B. The details described with respect to receptacles 704 and 706 are applicable to receptacle 804 and some of which are not repeated here only for the purpose of brevity. The high density receptacle 804 comprises a plurality of sets of pins (i.e., sets of pins 832*a*, 832*b*, 832*c*, 832*d*, and 828), a depression 830, a cable 824, and a housing, which includes a plurality of sets of walls. The plurality of sets of walls defines an elongated cavity 834. Each of the plurality of sets of walls defines a corresponding portion of the elongated cavity. For example, a first set of walls defines a first portion 834*a* of the elongated cavity. A second set of walls defines a second portion 834*b* of the elongated cavity. Each of the plurality of sets of walls supports a number of sets of the plurality of sets of pins. For example, the first set of walls supports four of the five total sets of pins. In particular, the first set of walls supports sets of pins 832*a*, 832*b*, 832*c*, and 832*d*. Each pin in each of the sets of pins 832*a*, 832*b*, 832*c*, and 832*d* protrudes into the first portion 834*a* of the elongated cavity. The second set of walls supports one of the five total sets of pins. In particular, the second set of walls supports the set of pins 828. Each pin in the set of pins 828 protrudes into the second portion 834*b* of the elongated cavity. At least two sets of the plurality of sets of pins are located at different depths measured along a length of the elongated cavity. The sets of pins 832*a*, 832*b*, 832*c*, and 832*d* are located at a first length (labeled in FIG. 9A) measured along the length of the elongated cavity of the receptacle 804 (i.e., measured relative to a fixed point on the housing such as an endpoint 828 of the receptacle). The set of pins 828 is located at a second length (labeled 'L10' in FIG. 9A) measured along the length of the elongated cavity of the receptacle 804 (e.g., measured relative to the fixed point on the housing such as the endpoint 828 of the receptacle). The first length L11 and the second length L10 are different positions measured along a length of the elongated cavity of the plug. The distance L10 is larger than the distance L11. In addition, the pins 828 are offset from the pins 832*a-d* by a third distance (labeled 'L12' in FIG. 9A). The distance L12 is equal to a difference between the distance L10 and the distance L11 (i.e., L12=L10-L11). The distance L12 is the distance by which the layers of pins are offset from one another. The distance L12 substantially matches the distance by which the layers of contacts are offset from one another on the plug 802 (i.e., distance L9). The cable 824 extends from a rear surface 826 of the receptacle 804. The cable 824 includes a plurality of wires. Each pin in each of the plurality of sets of pins is electrically coupled to a corresponding one of the plurality of wires in the cable 824. In some examples, the cable 824 includes wiring equivalent to that of five standard cables (e.g., five twisted pair cables, five Ethernet cables, and the like) for coupling to the five sets of pins of the receptacle 804. The depression 830 is larger than that on a standard receptacle (e.g., larger in width and depth relative to the depression 342 of FIG. 3A-2). The enlarged size of the depression 830 is, at least in part, to support an enlarged latch 820 of the plug 8-2. Each of the plurality of sets of pins (i.e., sets of pins 832*a*, 832*b*, 832*c*, 832*d*, and 828) is positioned about a corresponding portion of the elongated cavity at an angular position relative to an adjacent one of the plurality of sets of pins. In FIG. 9A a longitudinal axis of the housing is illustrated as a centerline located between the plug and receptacle. In some implementations, the angular positions (at which sets of pins are positioned about the housing) are measured about the longitudinal axis.

The dimensions and relative spacing of each set of pins corresponding to a standard 8P8C receptacle. For example, spacing between pins in each of the plurality of sets of pins matches spacing between pins of a standard 8P8C modular receptacle. Thus, each of the plurality of sets of pins (i.e., sets of pins 832*a*, 832*b*, 832*c*, 832*d*, and 828) is identical to one another (e.g., in size and shape). Similar pins are described with respect to FIGS. 3A-2 and are not repeated here only for brevity.

It is noted that each of the sets of pins need not be identical to one another. For example, the foremost set of pins (e.g., set 828) may be a 6P6C pin layout while each of the other sets of pins (e.g., sets 832*a-d*) may be an 8P8C pin layout. Thus, the sets of pins within each layer are identical to one another while each layer may have different pin layouts with respect to other layers. In still further examples, the sets of pins on a single layer may implement different pin layouts. For example, a single layer may include one or more 8P8C pin layouts (e.g., sets 832*a* and 832*c*) and one or more 6P6C pin layouts (e.g., sets 832*b* and 832*d*).

In the Example of FIGS. 8A, 8B, and 9A, the high density plug 802 and the high density receptacle 804 correspond to one another. As an example, a size and a shape of each of the plurality of housing portions of the plug 802 corresponds to a size and a shape of the corresponding portion of the elongated cavity of the receptacle 804. The size and shape of the first housing portion 806 substantially matches the size and shape of the first portion 834*a* of the elongated cavity. The size and shape of the second housing portion 812 substantially matches the size and shape of the second portion 834*b* of the elongated cavity. In addition, as described above, the distance L12 (i.e., the distance by which the layers of pins are offset from one another on the receptacle 804) substantially matches the distance L9 (i.e., the distance by which the layers of contacts are offset from one another on the plug 802). Each of the plurality of housing portions of the plug 802 fits within the corresponding portion of the elongated cavity of the receptacle 804. The first housing portion 806 fits within the first portion 834*a* of the elongated cavity. The second housing portion 812 fits within the second portion 834*b* of the elongated cavity. Such correspondence in size and dimensions of the plug and receptacle facilitates each of the plurality of sets of pins (on the receptacle 804) simultaneously contacting a corresponding one of the plurality of sets of contacts (on the plug 802) when the plug is inserted into the receptacle.

Figure 9B:
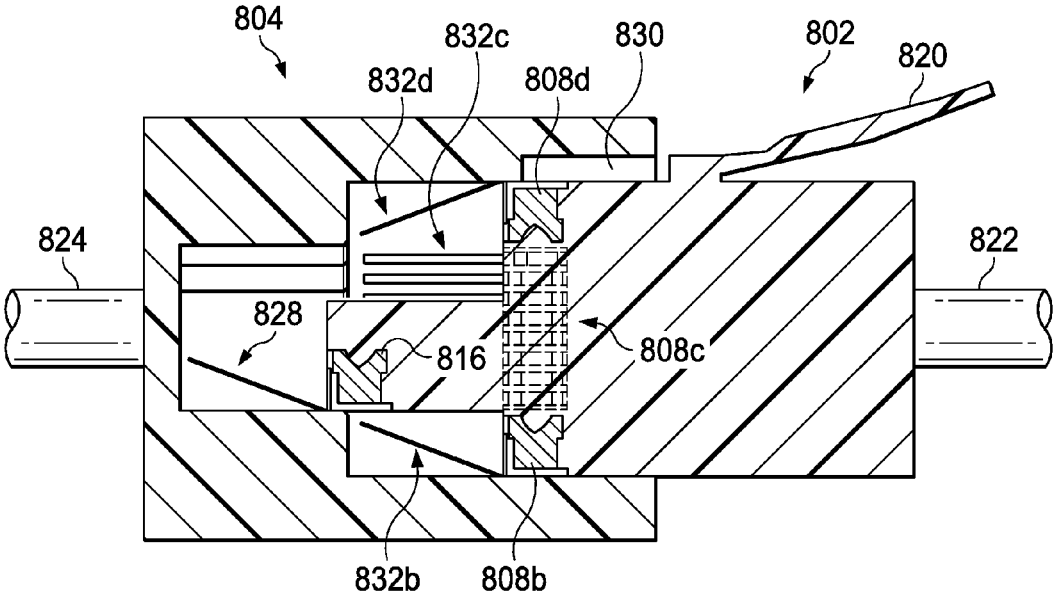
FIG. 9B is a cross-sectional view of the system of FIGS. 8A and 8B wherein the plug 802 and receptacle 804 are partially engaged with one another according to some embodiments of the present disclosure.

While FIGS. 8A, 8B, and 9A illustrate the plug 802 and receptacle 804 disengaged from one another, FIG. 9B illustrates a cross-sectional view of the plug 802 and receptacle 804 partially engaged with one another. Such partial engagement occurs during insertion of the plug 802 into the receptacle 804 and during withdrawal of the plug 802 from the receptacle 804. Turning to FIG. 9B, each of the plurality of housing portions of the plug 802 fits within the corresponding portion of the elongated cavity of the receptacle 804. The plug and the receptacle having corresponding size and dimensions (as described above) facilitates each of the plurality of sets of pins (on the receptacle 804) simultaneously contacting a corresponding one of the plurality of sets of contacts (on the plug 802) when the plug is inserted into the receptacle. In this example, the plug 802 is partially engaged in the receptacle 804 and, as a result, the following happen (substantially) simultaneously: each pin in the set of pins 828 contacts a corresponding contact in the set of contacts 816; each pin in the set of pins 832*a* contacts a corresponding contact in the set of contacts 808*a*, each pin in the set of pins 832*b* contacts a corresponding contact in the set of contacts 808*b*, each pin in the set of pins 832*c* contacts a corresponding contact in the set of contacts 808*c*, and each pin in the set of pins 832*d* contacts a corresponding contact in the set of contacts 808*d*. Thus, insertion of a single high density plug into a corresponding high density receptacle simultaneously creates connections between a several sets of pins and contacts (at least two of which are located at different layers of the plug or receptacle). Each of the plurality of sets of pins simultaneously contacting the corresponding one of the plurality of sets of electrical contacts creates an electrical pathway for bi-directional transmission of signals between the cable 822 and the cable 824. In other examples (where the receptacle 804 includes leads instead of a cable), each of the plurality of sets of pins simultaneously contacting the corresponding one of the plurality of sets of electrical contacts creates an electrical pathway for bi-directional transmission of signals between the cable 822 and the leads.

Figure 9C:
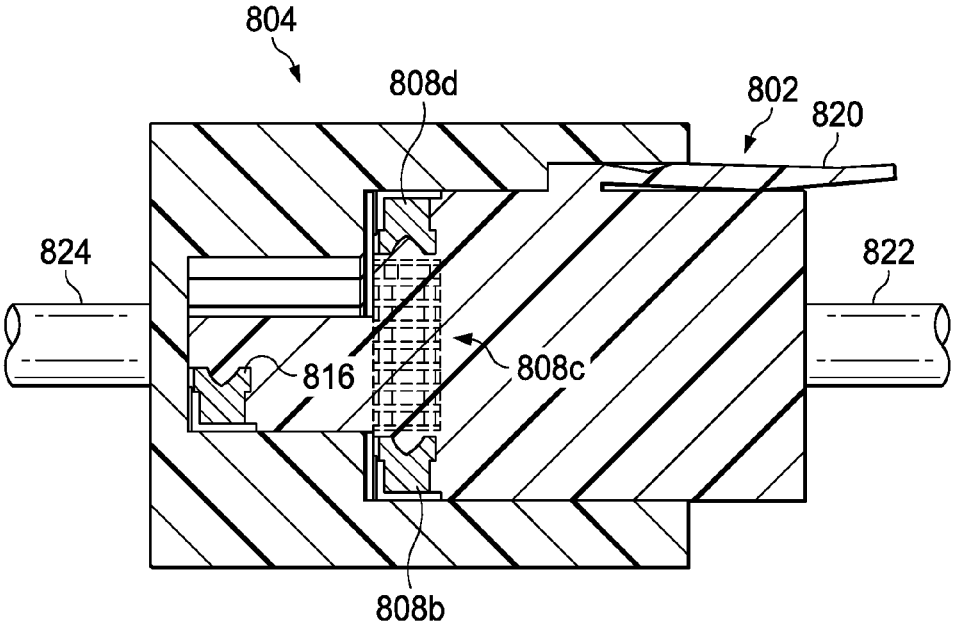
FIG. 9C is a cross-sectional view of the system of FIGS. 8A and 8B wherein the plug 802 and receptacle 804 are fully engaged with one another according to some embodiments of the present disclosure.

FIG. 9C illustrates a cross-sectional view of the plug 802 and the receptacle 804 fully engaged with one another. Simultaneous reference is made to reference numerals in each of FIGS. 9A, 9B, and 9C in the following discussion. The plug 802 can be selectively engaged with (or disengaged from) the receptacle 804. When the plug 802 is advanced further into the elongated cavity in the receptacle 804 (i.e., relative to the state shown in FIG. 9B), the contacts move (e.g., in a sliding motion) over the pins and remain in contact therewith, a result of which is illustrated in FIG. 9C. The depression 830 applies a force to the latch 820 and, thereby, holds the latch 820 in a deflected shape and engaged in the depression. In the state shown in FIG. 9C, the contacts and/or the housing of the plug 802 depress the pins on the receptacle 804. When the plug 802 is further withdrawn from the elongated cavity in the receptacle 804 (i.e., relative to the state shown in FIG. 9A), the contacts move (e.g., in a sliding motion) away from the pins and, thereby, break the physical contact between the contacts and pins. The depression 830 releases the force applied to the latch 820 and, thereby, facilitates the latch 820 engaged in the depression 830 and returning to the deflected shape.

In addition, a standard plug (e.g., similar to plug 302 of FIG. 3A-1) can be selectively engaged with (or disengaged from) the receptacle 804. The second portion 834*b* of the elongated cavity of the receptacle 804 has a general size and shape corresponding to a standard 8P8C modular receptacle, which advantageous facilitates the second portion being operable to receive insertion of a standard 8P8C plug (e.g., similar the discussed above with respect to FIGS. 6C and 6D). For example, when the plug 302 is inserted into the receptacle 804, contacts on the plug 302 and the pins on the receptacle 804 make contact with one another. The insertion of plug 302 into receptacle 804 simultaneously creates connections between the set of pins and the sets of contacts. While the contacts and the pins remain in contact with one another, signals can be bi-directionally transferred between the contacts and the pins.

Figure 10A:
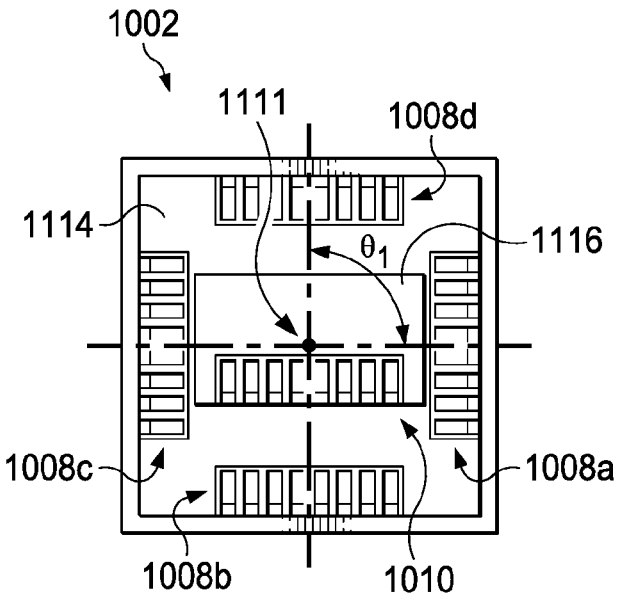
FIGS. 10A, 10B, and 10C illustrate several high density plugs, each having a different shape, size, and/or number of sets of contacts according to some embodiments of the present disclosure.
Figure 10B:
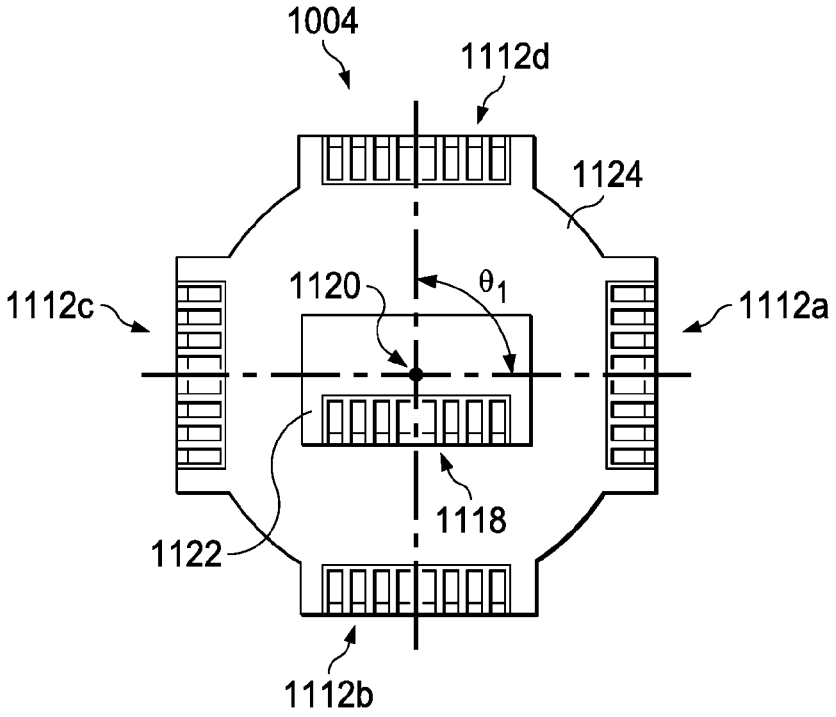
Figure 10C:
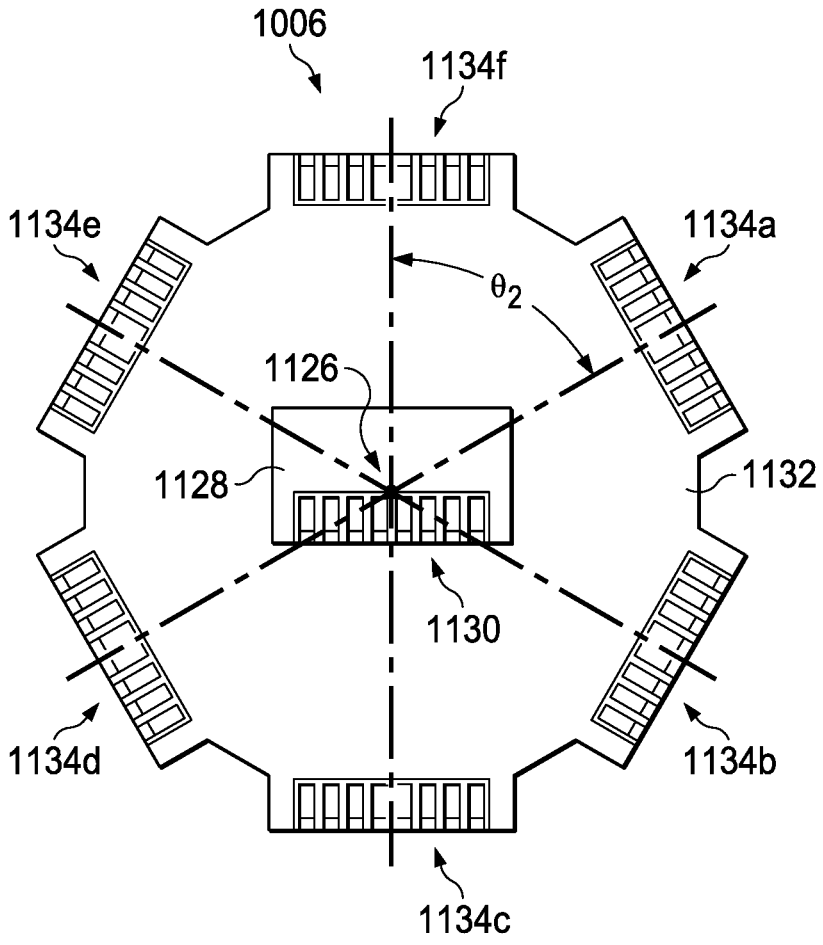

Turning to FIGS. 10A, 10B, and 10C, FIGS. 10A, 10B, and 10C illustrate several high density plugs, each having a different shape, size, and/or number of sets of contacts. Turning to FIG. 10A, FIG. 10A is a front view of a high density plug 1002 having a generally rectangular shape. The shape of a housing of the plug 1002 is a rectangular cube. The housing includes a first housing portion 1114 and a second housing portion 1116 each of which is rectangular cube in shape. The edges of the plug are approximately right angles. The plug 1002 includes two layers of contacts. A first layer of contacts includes four sets of contacts 1008*a-d*. A second layer of contacts includes one set of contacts 1010. Each set of contacts 1008*a-d* is positioned about the housing at an angular position (θ1) relative to an adjacent one of the sets of contacts. θ1 is equal to 90 degrees. The angle angular position θ1 is measured about the longitudinal axis 1111 and is measured between corresponding reference points on adjacent sets of contacts in the sets of contacts 1008*a-d* (i.e., in this case the reference is the centerline of each set of contacts). The plug 1002 is similar to the plug 402 of FIG. 4A-1.

Turning to FIG. 10B, FIG. 10B is a front view of a high density plug 1004 having a generally rounded shape. The shape of a housing of the plug 1004 is a tube. The housing includes a first housing portion 1124, which is tubular in shape, and a second housing portion 1122, which is a rectangular cube in shape. The first housing portion 1124 supports four sets of contacts 1112*a-d*. The second housing portion 1122 supports one set of contacts 1118. Each of the sets of contacts 1112*a-d* project from the tubular housing. The housing is rounded between each of the sets of contacts. The plug 1002 includes two layers of contacts (i.e., each corresponding to one of the two housing portions). A first layer of contacts includes sets of contacts 1112*a-d*. A second layer of contacts includes the set of contacts 1118. Each set of contacts 1112*a-d* is positioned about the housing at an angular position (θ1) relative to an adjacent one of the sets of contacts. θ1 is equal to about 90 degrees. The angle angular position θ1 is measured about the longitudinal axis 1120 and is measured between corresponding reference points on adjacent sets of contacts in the sets of contacts 1112*a-d* (i.e., in this case the reference is the centerline of each set of contacts).

Turning to FIG. 10C, FIG. 10C is a front view of the high density plug 1006 having a generally rounded shape. The shape of a housing of the plug 1006 is a faceted tube. The housing includes a first housing portion 1132, which is a faceted tube in shape, and a second housing portion 1128, which is a rectangular cube in shape. The first housing portion 1132 supports six sets of contacts 1134*a-f*. The second housing portion 1128 supports one set of contacts 1130. Each of the sets of contacts 1134*a-f* project from the faceted tubular housing. The housing is faceted between each of the sets of contacts. The plug 1006 includes two layers of contacts (i.e., each corresponding to one of the two housing portions). A first layer of contacts includes sets of contacts 1134*a-f*. A second layer of contacts includes the set of contacts 1130. Each set of contacts 1134*a-f* is positioned about the housing at an angular position (θ2) relative to an adjacent one of the sets of contacts. θ1 is equal to about 60 degrees. The angle angular position θ2 is measured about the longitudinal axis 1126 and is measured between corresponding reference points on adjacent sets of contacts in the sets of contacts 1134*a-f* (i.e., in this case the reference is the centerline of each set of contacts).

Each of the plugs 1002, 1004, and 1006 have a corresponding receptacle in which the plug fits, as is discussed extensively throughout the present disclosure. Each of such receptacles includes an elongated cavity that corresponds in size and shape to the plug. In addition, each of such receptacles includes corresponding sets of pins.

The shapes shown and illustrated in the various Figures of the present disclosure are for example purposes only. Various other shapes may be used herein without changing the scope of the present disclosure. For example, the plugs/receptacles can be rounded, tubular, or a faceted shape including any number of faces.

Moreover, though the description of connectors in FIGS. 4A-1, 4A-2, 4B, 4C, 4D, 4E, and 4F (and other Figures of the present disclosure) illustrate high density connectors having two layers of contacts/pins, two steps within the housing, the teachings of the present disclosure not limited to modular connectors having only two layers and/or steps. In other implementations, a high density connector may comprise three, four, five, or any number of layers of contacts/pins (and corresponding steps within the housing).

Additionally, it should be noted that with the examples provided above, functionalities may be described in terms of two, three, or four electronic devices and/or physical components. However, this has been done for purposes of clarity and example only. In certain cases, it may be easier to describe one or more of the functionalities of a given set of flows by only referencing a limited number of electronic devices and/or physical components (e.g., apparatuses, plugs, receptacles, electrical contacts, sets of electrical contact, pins, sets of pins). It should be appreciated that the systems described herein are readily scalable and, further, can accommodate a large number of components, as well as more complicated/sophisticated arrangements and configurations. Accordingly, the examples provided should not limit the scope or inhibit the broad techniques of (and/or apparatuses for) increasing density of pins and/or contacts in modular connectors, as potentially applied to a myriad of other architectures.

It is also important to note that the procedures described herein illustrate only some of the possible scenarios that may be executed by, or within, an apparatuses having high density of electrical contact and/or pins, as described herein. Some of these procedures may be deleted or removed where appropriate, or these procedures may be modified or changed considerably without departing from the scope of the present disclosure. In addition, a number of these operations have been described as being executed concurrently with, or in parallel to, one or more additional operations. However, the timing of these operations may be altered considerably. The preceding operational flows have been offered for purposes of example and discussion. The apparatus provides substantial flexibility in that any suitable arrangements, chronologies, configurations, and timing mechanisms may be provided without departing from the teachings of the present disclosure.

It should also be noted that many of the previous discussions may imply a single apparatus (e.g., electronic device, a plug and/or a receptacle, as described herein). In reality, there is a multitude of apparatuses in the delivery tier in certain implementations of the present disclosure. Moreover, the present disclosure can readily be extended to apply to storage systems, data centers, headends, further upstream in the architecture, though this is not necessarily correlated to 'm' electronic devices. Any such permutations, scaling, and configurations are clearly within the broad scope of the present disclosure.

Numerous other changes, substitutions, variations, alterations, and modifications may be ascertained to one skilled in the art and it is intended that the present disclosure encompass all such changes, substitutions, variations, alterations, and modifications as falling within the scope of the appended claims. In order to assist the United States Patent and Trademark Office (USPTO) and, additionally, any readers of any patent issued on this application in interpreting the claims appended hereto, Applicant wishes to note that the Applicant: (a) does not intend any of the appended claims to invoke paragraph six (6) of 35 U.S.C. section 112 as it exists on the date of the filing hereof unless the words "means for" or "step for" are specifically used in the particular claims; and (b) does not intend, by any statement in the specification, to limit this disclosure in any way that is not otherwise reflected in the appended claims.

What is claimed is:

1. An apparatus comprising:

a housing comprising a first housing portion coupled to a second housing portion;

a plurality of sets of electrical contacts supported by the first housing portion, each of the plurality of sets of electrical contacts being located proximate to a first planar end of the first housing portion;

an additional set of electrical contacts supported by the second housing portion, the additional set of electrical contacts being located proximate to a second planar end of the second housing portion, wherein each of the plurality of sets of electrical contacts is positioned about the first housing portion at an angular position relative to an adjacent one of the plurality of sets of electrical contacts; and wherein the plurality of sets of electrical contacts and the additional set of electrical contacts are located at different positions, each of the different positions being measured along a length of the housing.

2. The apparatus of claim 1, wherein the plurality of sets of electrical contacts circumscribes the first housing portion; and wherein the plurality of sets of electrical contacts and the additional set of electrical contacts being located at different positions measured along the length of the housing comprises:

the first planar end and the second planar end being substantially parallel to one another;

each the plurality of sets of electrical contacts being supported by the first planar end at a first distance from an end of the housing; and the additional set of electrical contacts being supported by the second housing portion at a second distance from the end of the housing, and the second distance being larger than the first distance.

3. The apparatus of claim 1, wherein the plurality of sets of electrical contacts is a first plurality of sets of electrical contacts and wherein the housing further comprises:

a plurality of housing portions, the plurality of housing portions comprising the first housing portion and the second housing portion, each of the plurality of housing portions comprises a corresponding planar end, the first planar end being the corresponding planar end of the first housing portion, and the second planar end being the corresponding planar end of the second housing portion;

a second plurality of sets of electrical contacts, the second plurality of sets of electrical contacts comprising the first plurality of sets of electrical contacts and the additional set of electrical contacts; and each of the plurality of housing portions supporting a number of sets of the second plurality of sets of electrical contacts proximate to the corresponding planar end.

4. The apparatus of claim 3, wherein the housing progressively narrows from a first end of the housing to a second end of the housing, the second end of the housing being at an opposite extreme end of the housing relative to the first end of the housing; and wherein the number of sets supported by each of the plurality of housing portions decreases relative to the number of sets supported by an adjacent one of the plurality of housing portions.

5. The apparatus of claim 3, wherein a foremost housing portion of the plurality of housing portions is a standard eight-position eight-contact (8P8C) modular plug.

6. The apparatus of claim 3, further comprising a cable comprising a plurality of wires, wherein each electrical contact in each of the plurality of sets of electrical contacts is electrically coupled to a corresponding one of the plurality of wires.

7. The apparatus of claim 3, further comprising each of the plurality of sets of electrical contacts and the additional set of electrical contacts being identical to one another wherein:

spacing between electrical contacts in each of the plurality of sets of electrical contacts and the additional set of electrical contacts match spacing between electrical contacts of an eight-position eight-contact (8P8C) modular plug, and each electrical contact in the plurality of sets of electrical contacts and the additional of set of electrical contacts are substantially identical to one another in physical dimensions.

8. An apparatus comprising:

a housing comprising a first set of walls and a second set of walls defining an elongated cavity, the first set of walls defining a first portion of the elongated cavity and the second set of walls defining a second portion of the elongated cavity;

a plurality of sets of pins supported by the first set of walls, each of the plurality of sets of pins protrudes into the first portion of the elongated cavity, wherein each of the plurality of sets of pins is positioned about the first portion of the elongated cavity at an angular position relative to an adjacent one of the plurality of sets of pins;

an additional of set of pins supported by one of the second set of walls, the additional of set of pins protrudes into the second portion of the elongated cavity; and wherein the plurality of sets of pins and the additional of set of pins are located at different depths measured along a length of the elongated cavity.

9. The apparatus of claim 8, wherein the plurality of sets of electrical contacts circumscribes the first housing portion; and wherein the plurality of sets of pins and the additional of set of pins being located at different depths measured along the length of the elongated cavity comprises:

each of the plurality of sets of pins is recessed a first depth into the elongated cavity;

the additional of set of pins is recessed a second depth into the elongated cavity; and wherein both the first depth and the second depth are measured relative to an open end of the elongated cavity and the second depth is larger than the first depth.

10. The apparatus of claim 8, wherein the plurality of sets of pins is a first plurality of sets of pins and wherein the housing further comprises:

a plurality of sets of walls, the plurality of sets of walls comprising the first set of walls and the second set of walls, each of the plurality of sets of walls defines a corresponding portion of the elongated cavity, the first portion of the elongated cavity being the corresponding portion of the elongated cavity associated with the first set of walls, and the second portion of the elongated cavity being the corresponding portion of the elongated cavity associated with the second set of walls;

a second plurality of sets of pins supported by the plurality of sets of walls, the second plurality of sets of pins comprising the first plurality of sets of pins and the additional set of pins; and each of the plurality of sets of walls supporting a number of sets of the second plurality of sets of pins, the number of sets of the second plurality of sets of pins protrudes into the corresponding portion of the elongated cavity.

11. The apparatus of claim 10, wherein the elongated cavity progressively narrows from a first end of the housing to a second end of the housing, the second end of the housing being at an opposite extreme end of the housing relative to the first end of the housing; and wherein the number of sets supported by each of the plurality of sets of walls decreases relative to the number of sets supported by an adjacent one of the plurality of sets of walls.

12. The apparatus of claim 10, wherein a foremost portion of the elongated cavity is a standard eight-position eight-contact (8P8C) modular receptacle.

13. The apparatus of claim 10, further comprising at least one of the group consisting of:

a cable comprising a plurality of wires, wherein each pin in each of the plurality of sets of pins is electrically coupled to a corresponding one of the plurality of wires, and a plurality of leads for coupling the receptacle to a circuit board, wherein each pin in each of the plurality of sets of pins is electrically coupled to a corresponding one of the plurality of leads.

14. The apparatus of claim 8, further comprising each of the plurality of sets of pins and the additional of set of pins are identical to one another wherein:

spacing between pins in each of the plurality of sets of pins and the additional of set of pins match spacing between electrical pins of an eight-position eight-contact (8P8C) modular receptacle, and each pin in the plurality of sets of pins and the additional of set of pin are substantially identical to one another in physical dimensions.

15. A system comprising:

a plug comprising:

a plurality of sets of electrical contacts, and a first housing comprising a plurality of housing portions, each of the plurality of housing portions comprising a corresponding planar end, and each of the plurality of housing portions supports a number of the plurality of sets of electrical contacts proximate to the corresponding planar end and each of the number of the plurality of sets of electrical contacts is positioned about a housing portion by which it is supported at an angular position relative to an adjacent one of the number of the plurality of sets of electrical contacts, wherein at least two sets of the plurality of sets of electrical contacts are located at different positions measured along a length of the first housing; and a receptacle comprising:

a plurality of sets of pins, and a second housing comprising a plurality of sets of walls, each of the plurality of sets of walls defines a corresponding portion of an elongated cavity, each of the plurality of sets of walls supporting a number of sets of the plurality of sets of pins, the number of sets of the plurality of sets of pins protrudes into the corresponding portion of the elongated cavity and each of the number of sets of the plurality of sets of pins is positioned about a set of walls by which it is supported at an angular position relative to an adjacent one of the number of sets of the plurality of sets of pins, wherein at least two sets of the plurality of sets of pins are located at different depths measured along a length of the elongated cavity.

16. The system of claim 15, wherein a size and a shape of each of the plurality of housing portions of the first housing corresponds to a size and a shape of the corresponding portion of the elongated cavity defined by the each of the plurality of sets of walls and each of the plurality of housing portions of the first housing fits within the corresponding portion of the elongated cavity.

17. The system of claim 16, wherein the plug is partially inserted into the receptacle, and each of the plurality of sets of pins simultaneously contacts a corresponding one of the plurality of sets of electrical contacts based, at least in part, on the plug being partially inserted into the receptacle.

18. The system of claim 17, wherein the plug further comprises a first cable comprised of a first plurality of wires, wherein each electrical contact in each of the plurality of sets of electrical contacts is electrically coupled to a corresponding one of the first plurality of wires.

19. The system of claim 18, wherein the receptacle further comprises a second cable comprised of a second plurality of wires, wherein each pin in each of the plurality of sets of pins is electrically coupled to a corresponding one of the second plurality of wires.

20. The system of claim 19, wherein the each of the plurality of sets of pins simultaneously contacting the corresponding one of the plurality of sets of electrical contacts creates an electrical pathway for bi-directional transmission of signals between the first cable and the second cable.

* * * * *